US008892429B2

(12) United States Patent
Suzuki et al.

(10) Patent No.: US 8,892,429 B2
(45) Date of Patent: Nov. 18, 2014

(54) ENCODING DEVICE AND ENCODING METHOD, DECODING DEVICE AND DECODING METHOD, AND PROGRAM

(75) Inventors: Shiro Suzuki, Kanagawa (JP); Yuuki Matsumura, Saitama (JP); Yasuhiro Toguri, Kanagawa (JP); Yuuji Maeda, Tokyo (JP)

(73) Assignee: Sony Corporation, Tokyo (JP)

( * ) Notice: Subject to any disclaimer, the term of this patent is extended or adjusted under 35 U.S.C. 154(b) by 248 days.

(21) Appl. No.: 13/583,994

(22) PCT Filed: Mar. 8, 2011

(86) PCT No.: PCT/JP2011/055294

§ 371 (c)(1),
(2), (4) Date: Sep. 11, 2012

(87) PCT Pub. No.: WO2011/114933

PCT Pub. Date: Sep. 22, 2011

(65) Prior Publication Data

US 2013/0006647 A1 Jan. 3, 2013

(30) Foreign Application Priority Data

Mar. 17, 2010 (JP) ..... P2010-061171

(51) Int. Cl.
*G10L 19/02* (2013.01)
*G10L 19/035* (2013.01)

(52) U.S. Cl.
CPC ..... *G10L 19/035* (2013.01); *G10L 19/0212* (2013.01)
USPC ..... 704/221

(58) Field of Classification Search
USPC ..... 704/219–230
See application file for complete search history.

(56) References Cited

U.S. PATENT DOCUMENTS

| | | | | |
|---|---|---|---|---|
| 5,479,560 | A | 12/1995 | Mekata | |
| 5,515,395 | A | 5/1996 | Tsutsui | |
| 5,953,696 | A * | 9/1999 | Nishiguchi et al. | 704/209 |
| 7,103,539 | B2 * | 9/2006 | Kleijn | 704/226 |
| 2008/0162122 | A1 * | 7/2008 | Rose et al. | 704/203 |
| 2011/0106545 | A1 * | 5/2011 | Disch et al. | 704/500 |

FOREIGN PATENT DOCUMENTS

| | | |
|---|---|---|
| JP | 6-208395 | 7/1994 |
| JP | 3186290 | 5/2001 |

OTHER PUBLICATIONS

International Search Report for International Application No. PCT/JP2011/055294 mailed May 24, 2011 from the Japanese Patent Office.

* cited by examiner

*Primary Examiner* — Abul Azad
(74) *Attorney, Agent, or Firm* — Finnegan, Henderson, Farabow, Garrett & Dunner, L.L.P.

(57) ABSTRACT

The present invention relates to an encoding device and an encoding method, a decoding device and a decoding method, and a program that reduce deterioration of sound quality due to encoding of audio signals.

An envelope emphasis part (51) emphasizes an envelope (ENV). A noise shaping part (52) divides an emphasized envelope (D) formed by emphasis of the envelope (ENV) by a value larger than 1, and subtracts noise shaping (G) specified by information (NS) from a result of the division. A quantization part (14) sets a result of the subtraction as a quantization bit count (WL), and quantizes a normalized spectrum (S1) formed by normalization of a spectrum (S0) based on the quantization bit count (WL). A multiplexing part (53) multiplexes the information (NS), a quantized spectrum (QS) formed by quantization of the normalized spectrum (S1), and the envelope (ENV). The present invention can be applied to an encoding device encoding audio signals, for example.

14 Claims, 31 Drawing Sheets

FIG. 2

| Header | ENV | WL | QS |
|---|---|---|---|

FIG. 6

| Header | ENV | NS | QS |
|---|---|---|---|

FIG. 23

| | | | |
|---|---|---|---|
| Header | ENV | NS' | QS |

ENCODING DEVICE AND ENCODING METHOD, DECODING DEVICE AND DECODING METHOD, AND PROGRAM

TECHNICAL FIELD

The invention relates to an encoding device and an encoding method, a decoding device and a decoding method, and a program, more specifically, an encoding device and an encoding method, a decoding device and a decoding method, and a program that reduce deterioration of sound quality due to encoding of audio signals.

BACKGROUND ART

As audio signal encoding methods, in general, there are well-known conversion encoding methods such as MP3 (Moving Picture Experts Group Audio Layer-3), AAC (Advanced Audio Coding), and ATRAC (Adaptive Transform Acoustic Coding).

FIG. 1 is a block diagram showing a configuration example of an encoding device encoding audio signals.

An encoding device 10 shown in FIG. 1 is formed by an MDCT (Modified Discrete Cosine Transform) part 11, a normalization part 12, a bit distribution part 13, a quantization part 14, and a multiplexing part 15, for example.

Sound PCM (Pulse Code Modulation) signal is input as an audio signal into the MDCT part 11 of the encoding device 10. The MDCT part 11 performs MDCT on the audio signal as a time domain signal to obtain a spectrum S0 as a frequency domain signal. The MDCT part 11 supplies the spectrum S0 to the normalization part 12.

The normalization part 12 extracts envelopes ENV by a plurality of spectra called quantization units from the spectrum S0, and supplies the same to the bit distribution part 13 and the multiplexing part 15. In addition, the normalization part 12 normalizes the spectrum S0 using the envelope ENV by quantization unit, and supplies a resultant normalized spectrum S1 to the quantization part 14.

If the envelope ENV is supplied from the normalization part 12, the bit distribution part 13 decides quantization information WL of the normalized spectrum S1 based on the envelope ENV, such that the bit count in a bit stream BS generated by the multiplexing part 15 falls within a desired range, according to a preset bit distribution algorithm. The quantization information WL is information indicative of quantization accuracy, and refers here to a quantization bit count. The bit distribution part 13 supplies the quantization information WL to the quantization part 14.

If there is feedback from the quantization part 14 on a bit count N in a quantized spectrum QS resulting from quantization of the normalized spectrum S1 based on the previous quantization information WL, the bit distribution part 13 determines based on the bit count N whether the bit count in the bit stream BS falls within a desired range. If determining that the bit count in the bit stream BS does not fall within a desired range, the bit distribution part 13 newly decides quantization information WL such that the bit count in the bit stream BS falls within a desired range. In addition, the bit distribution part 13 supplies the new quantization information WL to the quantization part 14.

In contrast, if determining that the bit count in the bit stream BS falls within a desired range, the bit distribution part 13 instructs the quantization part 14 for producing an output, and supplies the current quantization information WL to the multiplexing part 15.

The quantization part 14 quantizes the normalized spectrum S1 by quantization unit supplied from the normalization part 12, based on the quantization information WL supplied from the bit distribution part 13. The quantization part 14 supplies the bit count N in the resultant quantized spectrum QS to the bit distribution part 13. If an instruction for producing an output is issued from the bit distribution part 13, the quantization part 14 supplies the quantized spectrum QS based on the current quantization information WL to the multiplexing part 15.

The multiplexing part 15 multiplexes the envelope ENV supplied from the normalization part 12, the quantization information WL supplied from the bit distribution part 13, and the quantized spectrum QS supplied from the quantization part 14, thereby generating a bit stream BS. The multiplexing part 15 outputs the bit stream BS as a result of encoding.

As in the foregoing, the encoding device 10 generates not only the envelope ENV and the quantized spectrum QS but also the bit stream BS including the quantization information WL. This makes it possible to, at decoding of the bit stream BS, restore the normalized spectrum S1 from the quantized spectrum QS.

FIG. 2 is a diagram showing a configuration example of the bit stream BS generated by the multiplexing part 15 shown in FIG. 1.

As shown in FIG. 2, the bit stream BS is formed by a header Header including an upper limit value of the spectrum and the like, the envelope ENV, the quantization information WL, and the quantized spectrum QS.

As shown in FIG. 3, both the envelope ENV and the quantization information WL have values by quantization unit. Therefore, not only the quantized spectrum QS but also the envelope ENV and the quantization information WL are needed corresponding to the number of quantization units. Accordingly, assuming that a quantization unit count is designated as U, a bit count NWL required for transmission of the quantization information WL becomes a value of multiplication of the bit count in the quantization information WL and the quantization unit count U. As a result, the larger the quantization unit count U becomes, the more the bit count NWL increases.

In FIG. 3, k in [k] denotes the index of quantization units, and i an arbitrary value. In this arrangement, the index is set such that lower-frequency quantization units are given 1 or subsequent numbers.

In addition, the bit count for the envelope ENV by quantization unit is frequently determined in advance. Therefore, the bit distribution part 13 modifies the quantization information WL to change the bit count N in the quantized spectrum QS, thereby controlling the bit count in the bit stream BS to a determined value.

FIG. 4 is a block diagram showing a configuration example of a decoding device decoding a result of encoding by the encoding device 10 shown in FIG. 1.

A decoding device 20 shown in FIG. 4 is formed by a separation part 21, an inverse quantization part 22, an inverse normalization part 23, and an inverse MDCT part 24.

Input into the separation part 21 of the decoding device 20 is the bit stream BS as a result of encoding by the encoding device 10. The separation part 21 separates the envelope ENV and the quantization information WL from the bit stream BS. The separation part 21 also separates the quantized spectrum QS from the bit stream BS, based on the quantization information WL. The separation part 21 supplies the envelope ENV to the inverse normalization part 23 and supplies the quantization information WL and the quantized spectrum QS to the inverse quantization part 22.

The inverse quantization part 22 inversely quantizes the quantized spectrum QS based on the quantization information WL supplied from the separation part 21, and supplies a resultant normalized spectrum S1 to the inverse normalization part 23.

The inverse normalization part 23 inversely normalizes the normalized spectrum S1 supplied from the inverse quantization part 22, using the envelope ENV supplied from the separation part 21, and then supplies a resultant spectrum S0 to the inverse MDCT part 24.

The inverse MDCT part 24 performs inverse MDCT on the spectrum S0 as a frequency domain signal supplied from the inverse normalization part 23, thereby obtaining a sound PCM signal as a time domain signal. The inverse MDCT part 24 outputs the sound PCM signal as an audio signal.

As in the foregoing, the encoding device 10 includes the quantization information WL in the bit stream BS, which makes it possible to match an audio signal to be encoded and a decoded audio signal, even if the quantization information WL is arbitrarily modified at the encoding device 10. Therefore, the encoding device 10 can control the bit count in the bit stream BS using the quantization information WL. In addition, the encoding device 10 can solely be improved to set an optimum value in the quantization information WL, thereby achieving enhancement in sound quality.

However, when a large number of bits is needed for transfer of the quantization information WL, the bit count in the quantized spectrum QS relatively decreases, which leads to degradation in sound quality.

Accordingly, there is suggested an encoding method including dividing the quantization information WL into a fixed value uniquely determined at the encoding device and the decoding device and a differential value obtained by subtracting the fixed value from the quantization information WL, and encoding the differential value by a low bit count (for example, see Patent Document 1).

CITATION LIST

Patent Document

Patent Document 1: Japanese Patent No. 3186290

SUMMARY OF THE INVENTION

Problems to be Solved by the Invention

However, the differential value is required corresponding to the number of quantized units, and hence the bit count needed for transfer of the quantization information WL does not become sufficiently small. As a result, it is difficult to reduce deterioration in sound quality. This causes a large obstacle to realization of high-frequency encoding, that is, low-bit rate encoding.

The invention is devised in light of such circumstances, and an object of the invention is to reduce deterioration in sound quality due to encoding of audio signals.

Solutions to Problems

An encoding device in a first aspect of the invention is an encoding device, including a normalization means that extracts an envelope from a spectrum of an audio signal and normalizes the spectrum using the envelope; an envelope emphasis means emphasizing the envelope; a noise shaping means that divides the envelope emphasized by the envelope emphasis means by a value larger than 1 and subtracts noise shaping specified by predetermined information from a result of the division; a quantization means that sets a result of the subtraction by the noise shaping means as a quantization bit count and quantizes the spectrum normalized by the normalization means, based on the a quantization bit count; and a multiplexing means that multiplexes the predetermined information, the spectrum quantized by the quantization means, and the envelope.

An encoding method and a program in the first aspect of the invention correspond to the encoding device in the first aspect of the invention.

In the first aspect of the invention, the envelope is extracted from the spectrum of an audio signal, the spectrum is normalized using the envelope, the envelope is emphasized, the emphasized envelope is divided by a value larger than 1, noise shaping specified by predetermined information is subtracted from the result of the division, the result of the subtraction is set as a quantization bit count, the normalized spectrum is quantized based on the number of the quantization bits, and the predetermined information, the quantized spectrum, and the envelope are multiplexed.

A decoding device in a second aspect of the invention is a decoding device including: an information separation means that separates the predetermined information and the envelope from the multiplexed predetermined information, a quantized spectrum of an audio signal, and an envelope of the spectrum; an envelope emphasis means emphasizing the envelope; a noise shaping means that divides the envelope emphasized by the envelope emphasis means by a value larger than 1 and subtracts noise shaping specified by the predetermined information from a result of the division; a spectrum separation means that separates the quantized spectrum from the multiplexed predetermined information, the quantized spectrum, and the envelope, using a result of the subtraction by the noise shaping means as a quantization bit count; an inverse quantization means that inversely quantizes the quantized spectrum based on the quantization bit count; and an inverse normalization means that inversely normalizes the spectrum inversely quantized by the inverse quantization means, using the envelope.

A decoding method and a program in the second aspect of the invention correspond to the decoding device in the second aspect of the invention.

In the second aspect of the invention, the predetermined information and the envelope are separated from the multiplexed predetermined information, a quantized spectrum of an audio signal, and an envelope of the spectrum; the envelope is emphasized; the emphasized envelope is divided by a value larger than 1; noise shaping specified by the predetermined information is subtracted from a result of the division; using a result of the subtraction as a quantization bit count, the quantized spectrum is separated from the multiplexed predetermined information, the quantized spectrum, and the envelope; the quantized spectrum is inversely quantized based on the quantization bit count; and the inversely quantized spectrum is inversely normalized using the envelope.

The encoding device in the first aspect and the decoding device in the second aspect may be independent devices or inner blocks constituting one device.

Effects of the Invention

According to the first aspect of the invention, it is possible to reduce deterioration in sound quality due to encoding of audio signals.

In addition, according to the second aspect of the invention, it is possible to decode audio signals that are encoded so as to reduce deterioration in sound quality due to encoding.

BRIEF DESCRIPTION OF DRAWINGS

FIG. 2 is a diagram showing a configuration example of a bit stream generated by a multiplexing part shown in FIG. 1.

FIG. 6 is a diagram showing a configuration example of a bit stream generated by a multiplexing part shown in FIG. 5.

FIG. 23 is a diagram showing a configuration example of a bit stream generated by a multiplexing part shown in FIG. 22.

MODE FOR CARRYING OUT THE INVENTION

First Embodiment

Configuration Example of a First Embodiment of the Encoding Device

Figure 5:
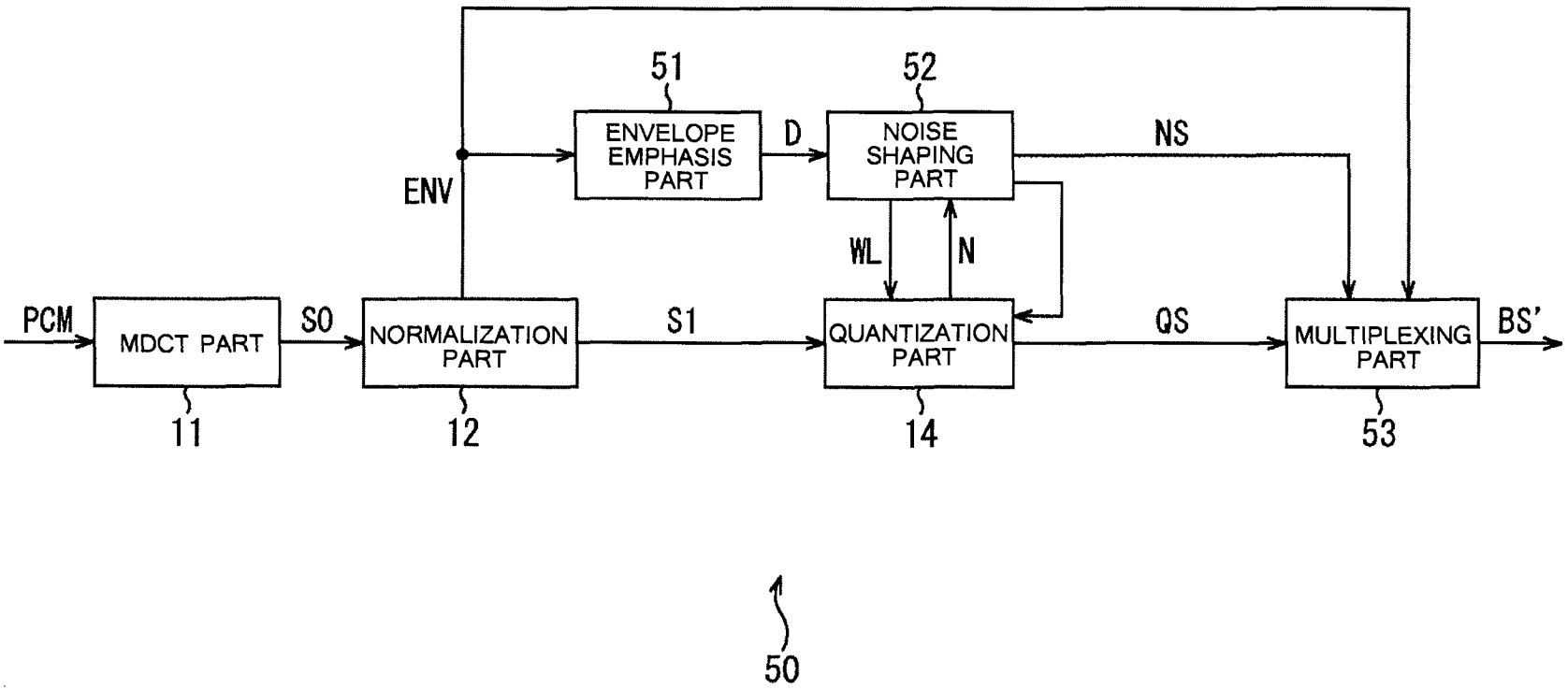
FIG. 5 is a block diagram showing a configuration example of a first embodiment of a display device to which the invention is applied.

FIG. 5 is a block diagram showing a configuration example of a first embodiment of a display device to which the invention is applied.

Figure 1:
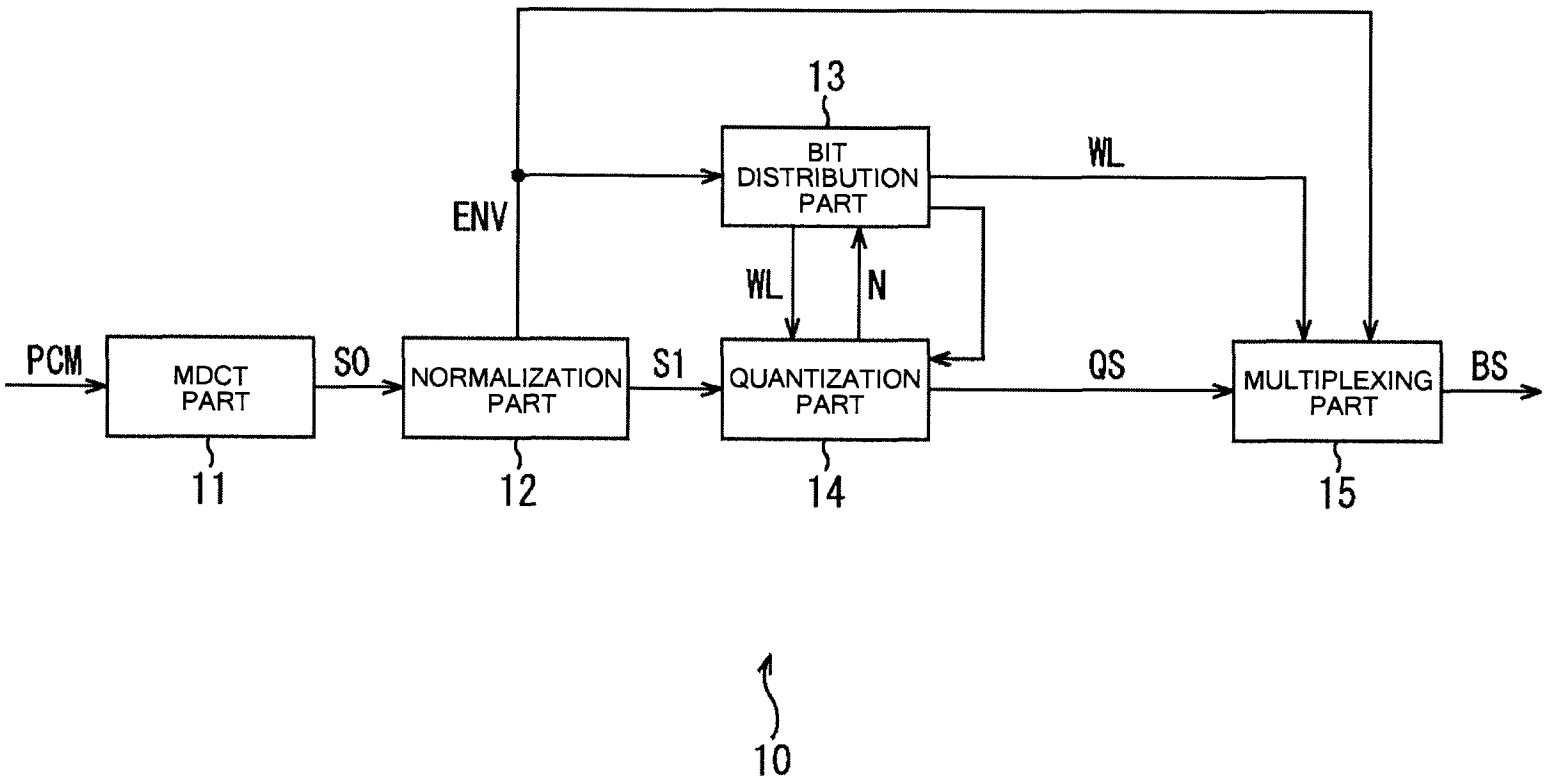
FIG. 1 is a block diagram showing a configuration example of an encoding device encoding audio signals.
Figure 3:
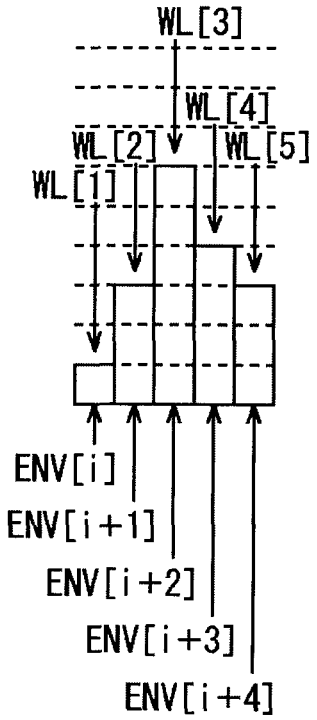
FIG. 3 is a diagram for describing envelopes and quantization information.

In the configuration shown in FIG. 5, the same components as those in the configuration shown in FIG. 1 are given the same reference numerals as those in the configuration shown in FIG. 1. Duplicated descriptions are omitted as appropriate.

The configuration of an encoding device 50 shown in FIG. 5 is different from the configuration shown in FIG. 1, in that an envelope emphasis part 51 and a noise shaping part 52 are provided in place of the bit distribution part 13, and a multiplexing part 53 is provided in place of the multiplexing part 15.

An envelope emphasis part 51 emphasizes an envelope ENV[k] by quantization unit extracted from the normalization part 12. Specifically, the envelope emphasis part 51 generates an emphasized envelope D[k] by quantization unit in which increase and decrease in value of the envelope ENV[k] are emphasized, using the envelope ENV[k] by quantization unit extracted from the normalization part 12. Then, the envelope emphasis part 51 supplies the emphasized envelope D[k] to the noise shaping part 52. Details of the envelope emphasis part 51 will be provided with reference to FIG. 7 described later.

The noise shaping part 52 subtracts noise shaping G[k] by quantization unit specified by information NS, from a value D[k]/2 obtained by dividing by 2 the emphasized envelope D[k] by quantization unit supplied from the envelope emphasis part 51, for example. The information NS refers to a lowest value L and a highest value H of noise shaping G of all quantization units. The noise shaping part 52 supplies a resultant value as quantization information WL[k] to the quantization part 14.

In addition, if the emphasized envelope D[k] is supplied from the envelope emphasis part 51, the noise shaping part 52 determines the information NS such that the bit count in a bit stream BS' generated by the multiplexing part 53 falls within a desired range, based on the emphasized envelope D[k]. Further, if there is a feedback from the quantization part 14 on the bit count N in a quantized spectrum QS[k] resulting from the quantization of the normalized spectrum S1 based on the previous quantization information WL, the noise shaping part 52 determines whether the bit count in the bit stream BS' falls within a desired range based on the bit count N. If it is determined that the bit count in the bit steam BS' does not fall within a desired range, the noise shaping part 52 newly decides information NS so that the bit count in the bit stream BS' falls within a desired range. Accordingly, the new quantization information WL is supplied to the quantization part 14.

Meanwhile, if it is determined that the bit count in the bit stream BS' falls within a desired range, the noise shaping part 52 instructs the quantization part 14 for producing an output, and supplies the current information NS to the multiplexing part 53. Details of the noise shaping part 52 will be provided with reference to FIG. 9 described later.

The multiplexing part 53 generates the bit stream BS' by multiplexing the envelope ENV[k] supplied from the normalization part 12, the information NS supplied from the noise shaping part 52, and the quantized spectrum QS[k] supplied from the quantization part 14. The multiplexing part 53 outputs the bit stream BS' as a result of encoding.

As in the foregoing, the encoding device 50 adjusts the bit count in the bit stream BS', not by controlling directly the quantization information WL but by controlling the information NS specifying the noise shaping G for use in generation of the quantization information WL. In addition, the encoding device 50 includes the information NS, in place of the quantization information WL, in the bit stream BS'.

[Configuration Example of the Bit Stream]

FIG. 6 is a diagram showing a configuration example of the bit stream BS' generated by the multiplexing part 53 shown in FIG. 5.

As shown in FIG. 6, the bit stream BS' is formed by a header Header including an upper limit value of a spectrum and the like, the envelope ENV[k], the information NS, and the quantized spectrum QS[k].

As in the foregoing, the bit stream BS' includes the information NS formed by the lowest value L and the highest value H of the noise shaping G, in place of the quantization information WL, and thus the bit count needed for transfer of the quantization information WL becomes a summed value NNS of the bit count NL of the lowest value L and the bit count NH of the highest value H. Therefore, if the quantized unit count U is sufficiently large, the summed value NNS becomes sufficiently small as compared to the multiplied value of the bit count in the quantization information WL and the quantized unit count U. That is, the bit count needed for transfer of the quantization information WL at the encoding device 50 becomes sufficiently smaller as compared to the conventional case where the quantization information WL is included in the bit stream BS.

As a result, in the bit stream BS', the bit count in the quantized spectrum QS[k] becomes large relative to the conventional case, thereby reducing deterioration in sound quality due to encoding.

[Detailed Configuration Example of the Envelope Emphasis Part]

Figure 7:
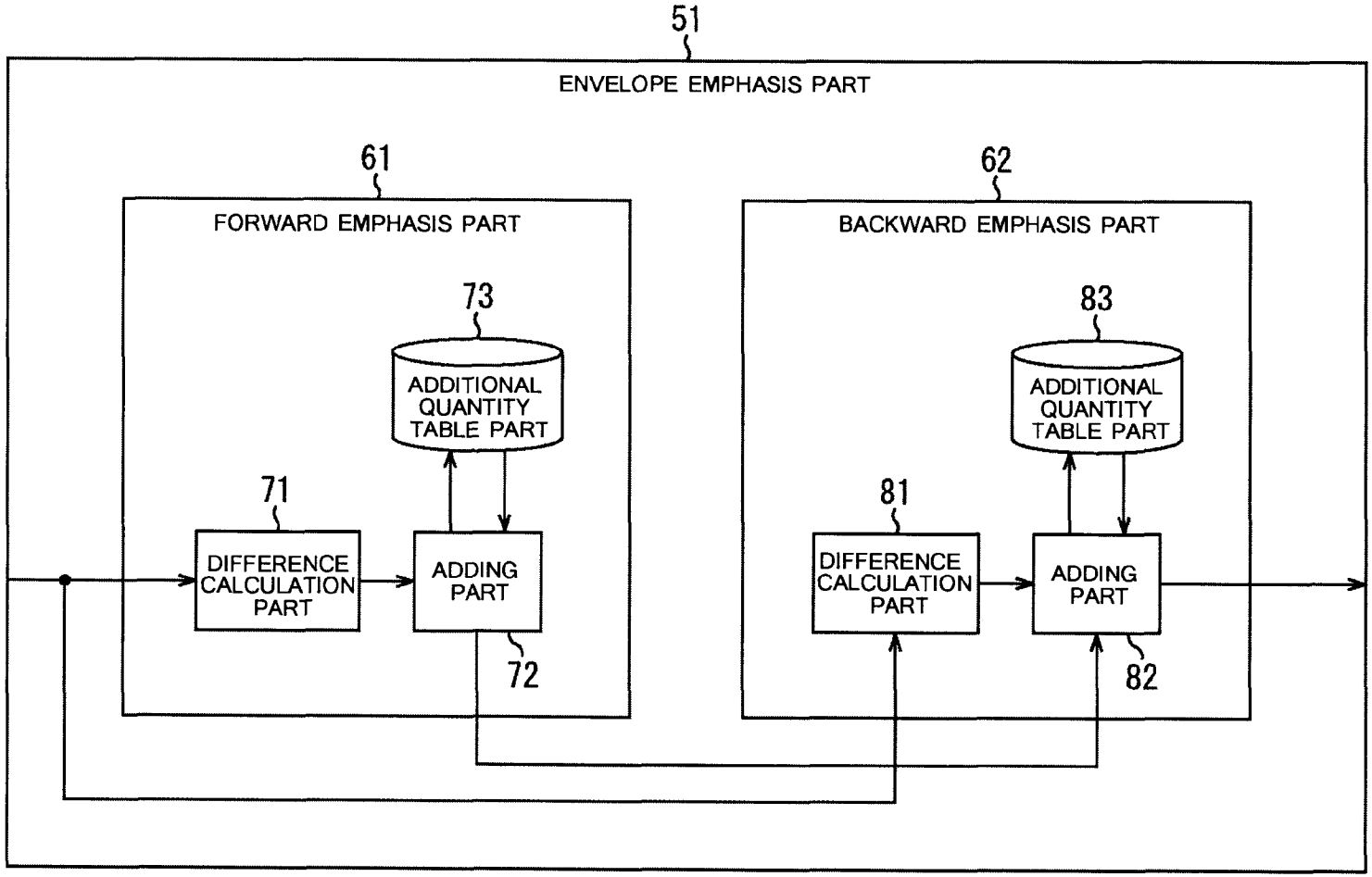
FIG. 7 is a block diagram showing a detailed configuration example of an envelope emphasis part shown in FIG. 5.

FIG. 7 is a block diagram showing a detailed configuration example of the envelope emphasis part 51 shown in FIG. 5.

As shown in FIG. 7, the envelope emphasis part 51 is formed by a forward emphasis part 61 and a backward emphasis part 62, for example.

The forward emphasis part 61 is formed by a difference calculation part 71, an adding part 72, and an additional quantity table part 73.

The difference calculation part 71 of the forward emphasis portion 61 subtracts the envelope ENV[k] of a quantization unit with an index k, from the envelope ENV[k+1] of a quantization unit with an index k+1 supplied from the normalization part 12 shown in FIG. 5, thereby determining a difference diff[k+1]. The difference calculation part 71 supplies the determined difference diff[k+1] and the envelope ENV[k+1] to the adding part 72.

If the difference diff[k+1] supplied from the difference calculation part 71 is a positive value, the adding part 72 reads an additional quantity corresponding to the difference diff[k+1] from the additional quantity table part 73, and adds the additional quantity to the envelope ENV[k+1]. The adding part 72 supplies a resultant value as a forward emphasized envelope Do[k+1] to the backward emphasis part 62.

The additional quantity table part 73 stores an additional quantity table as a table in which differences diff and additional quantities are associated. For example, the additional quantity table registers an additional quantity "1" corresponding to a difference diff "1", and an additional quantity "2" corresponding to a difference diff "2." In addition, the additional quantity table registers an additional quantity "3" corresponding to a difference diff "3", registers an additional quantity "4" corresponding to a difference diff "4", and registers an additional quantity "5" corresponding to a difference diff "5 or more". As a matter of course, the arrangement of the additional quantity table is not limited to this.

The backward emphasis part 62 is formed by a difference calculation part 81, an adding part 82, and an additional quantity table part 83.

The difference calculation part 81 of the backward emphasis part 62 subtracts the envelope ENV[k+1] from the envelope ENV[k] supplied from the normalization part 12, thereby determining the difference diff[k]. The difference calculation part 81 supplies the determined diff[k] to the adding part 82.

If the difference diff[k] supplied from the difference calculation part 81 is a positive value, the adding part 82 reads an additional quantity corresponding to the difference diff[k] from the additional quantity table part 83. The adding part 82 adds the additional quantity to a forward emphasized envelope Do[k] supplied from the adding part 72. The adding part 82 supplies a resultant value as an emphasized envelope D[k] to the noise shaping part 52 (FIG. 5).

The additional quantity table part 83 stores an additional quantity table as a table in which differences diff and additional quantities are associated. The additional quantity table stored in the additional quantity table part 73 and the additional quantity table stored in the additional quantity table part 83 may be different, although these tables are the same in this configuration.

[Description of a Process Performed by the Envelope Emphasis Part]

Figure 8:
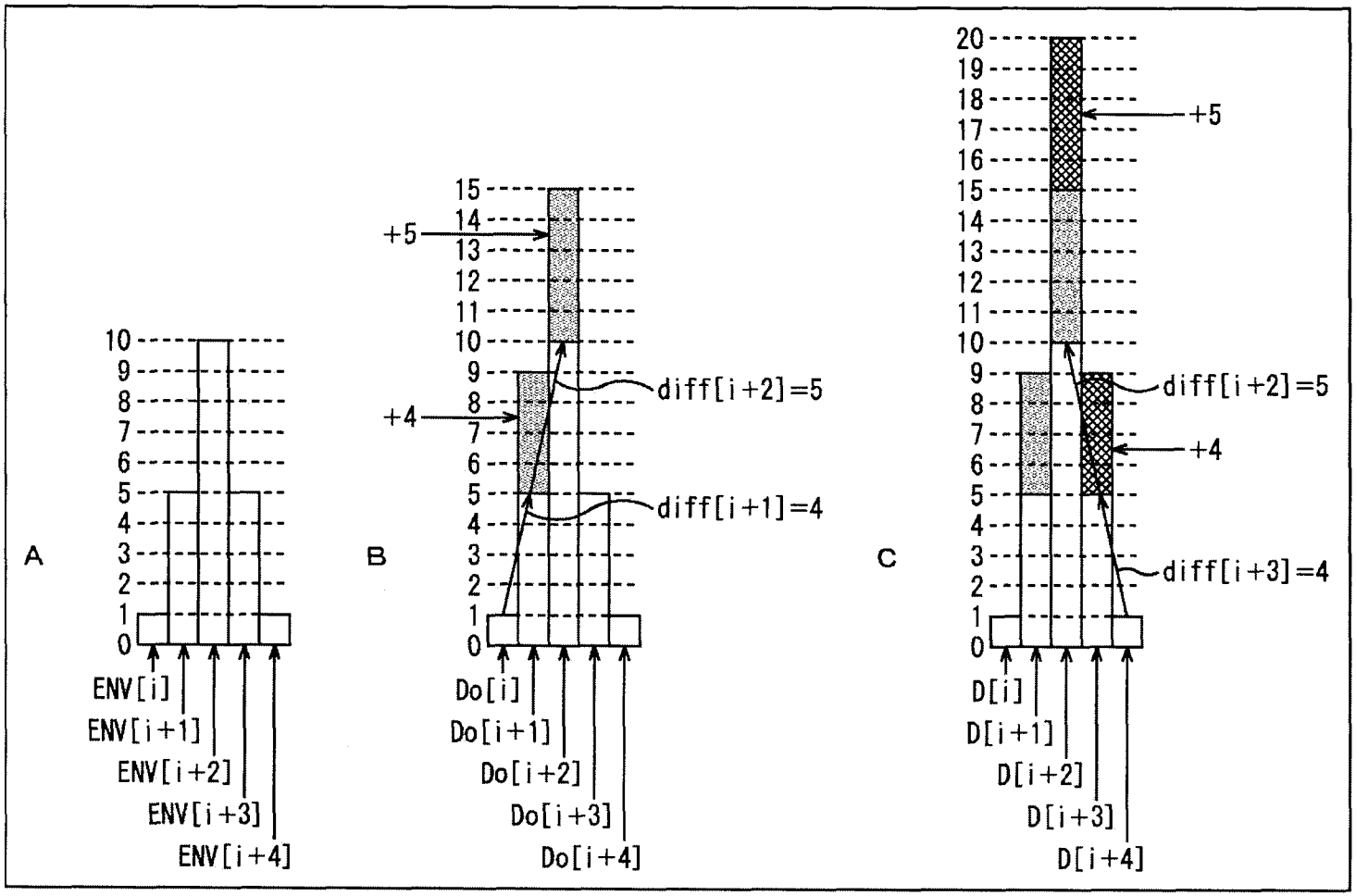
FIG. 8 is a diagram for describing a process performed by the envelope emphasis part shown in FIG. 7.

FIG. 8 is a diagram for describing a process performed by the envelope emphasis part 51 shown in FIG. 7.

With reference to FIG. 8, a process performed by the envelope emphasis part 51 will be described, based on the assumption that envelopes ENV[i] to ENV[i+4] supplied from the normalization part 12 are 1, 5, 10, 5, and 1 in this order, as shown in FIG. 8A.

In this case, differences diff[i+1] to diff[i+4] determined by the difference calculation part 71 (FIG. 7) of the forward emphasis portion 61 are 4, 5, −5, and −4 in this order. The difference diff[i] is set at 0 because there is no index smaller than i. Therefore, as shown in FIG. 8B, a forward emphasized envelope Do[i] remains 1, and a forward emphasized envelope Do[i+1] constitutes a summed value 9 of the envelope ENV[i+1] and an additional quantity "4" corresponding to a difference diff[i+1] of "4". In addition, a forward emphasized envelope Do[i+2] constitutes a summed value 15 of an envelope ENV[i+2] and an additional quantity "5" corresponding to the difference diff[i+2] of "5", and a forward emphasized envelope Do[i+3] remains 5. A forward emphasized envelope Do[i+4] remains 1.

In addition, the differences diff[i] to diff[i+3] determined by the difference calculation part 82 of the backward emphasis part 62 are −4, −5, 5, and 4 in this order. The difference diff[i+4] is 0 here because there is no index larger than i+4.

Therefore, as shown in FIG. 8C, an emphasized envelope D[i] remains 1, and an emphasized envelope D[i+1] remains 9 as with the forward emphasized envelope Do[i+1]. In addition, an emphasized envelope D[i+2] constitutes a summed value 20 of the forward emphasized envelope Do[i+2] and an additional quantity "5" corresponding to the difference diff[i+2] of "5", and an emphasized envelope D[i+3] constitutes an summed value 9 of the forward emphasized envelope Do[i+3] and an additional quantity "4" corresponding to the difference diff[i+3] of "4". In addition, an emphasized envelope D[i+4] remains 1.

As in the foregoing, from the envelope ENV shown in FIG. 8A, the envelope emphasis part 51 generates emphasized envelopes D in which protruding parts of the envelopes ENV are further emphasized as shown in FIG. 8C.

[Detailed Configuration Example of the Noise Shaping Part]

Figure 9:
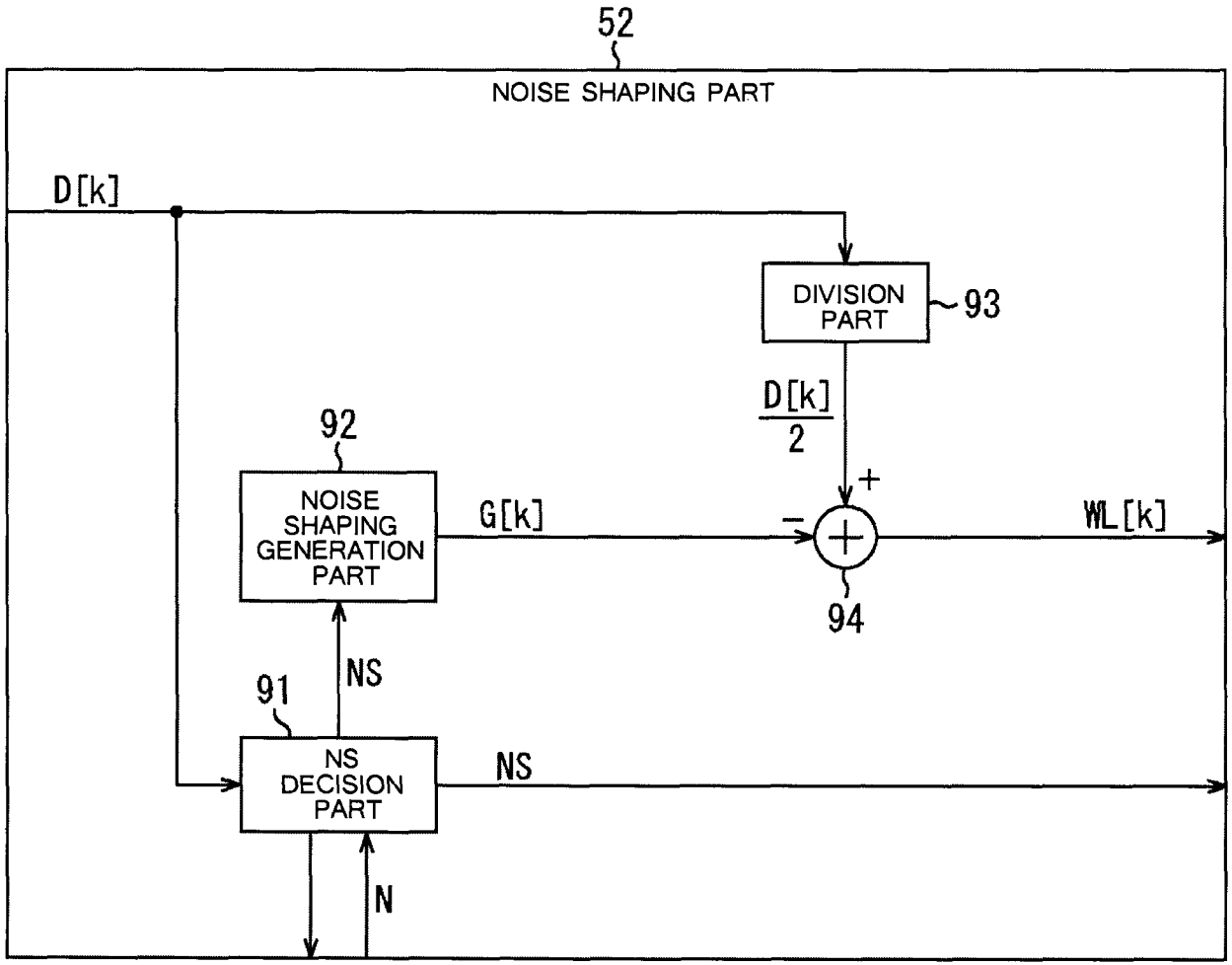
FIG. 9 is a block diagram showing a detailed configuration example of a noise shaping part shown in FIG. 5.

FIG. 9 is a block diagram showing a detailed configuration example of the noise shaping part 52 shown in FIG. 5.

As shown in FIG. 9, the noise shaping part 52 is formed by an NS decision part 91, a noise shaping generation part 92, a division part 93, and a subtraction part 94.

If the emphasized envelope D[k] for each of the quantization units is supplied from the envelope emphasis part 51 shown in FIG. 5, the NS decision part 91 of the noise shaping part 52 decides the information NS based on the emphasized envelope D[k], such that the bit count in the bit stream BS' falls within a desired range.

In addition, if there is feedback from the quantization part 14 shown in FIG. 5 on the bit count N for a quantized spectrum QS[k] quantized based on the quantization information WL specified by the previous information NS, the NS decision part 91 determines, based on the bit count N, whether the bit count in the bit stream BS' falls within a desired range. If determining that the bit count in the bit stream BS' does not fall within a desired range, the NS decision part 91 newly decides information NS such that the bit count in the bit stream BS' falls within the desired range.

For example, if the bit count in the bit stream BS' is under the desired range, the NS decision part 91 decreases the highest value H in the information NS. In contrast, if the bit count in the bit stream BS' is above the desired range, the NS decision part 91 first increases the highest value H. Then, if the bit count in the bit stream BS' is still above the desired range despite the increased highest value H, the NS decision part 91 increases the lowest value L. The NS decision part 91 supplies the decided NS to the noise shaping generation part 92.

In contrast, if determining that the bit count in the bit stream BS' falls within the desired range, the NS decision part 91 supplies the current information NS to the multiplexing part 53 (FIG. 5), and instructs the quantization part 14 for producing an output.

The noise shaping generation part 92 generates noise shaping G[k] for each of the quantization units, based on the information NS supplied from the NS decision part 91. Specifically, the noise shaping generation part 92 sets the lowest value L included in the information NS as noise shaping for the lowest-frequency, that is, the first quantization unit, and sets the highest value H as noise shaping for the highest-frequency, that is, the last quantization unit. Then, the noise shaping generation part 92 quantizes a straight line connecting the noise shaping for the first quantization unit and the noise shaping for the last quantization unit, thereby generating noise shaping G[k] for each of the quantization units. After that, the noise shaping generation part 92 supplies the generated noise shaping G[k] to the subtraction part 94.

The division part 93 divides by 2 the emphasized envelope D[k] for each of the quantization units supplied from the envelope emphasis part 51 shown in FIG. 5. The division part 93 supplies a resultant divided value D[k]/2 to the subtraction part 94.

The subtraction part 94 subtracts the noise shaping G[k] supplied from the noise shaping generation part 92, from the divided value D[k]/2 supplied from the division part 93, and supplies a resultant subtracted value as quantization information WL[k] to the quantization part 14 (FIG. 5).

As in the foregoing, the noise shaping part 52 divides the emphasized envelope D[k] by a value larger than 1, thereby to smooth out distribution of the quantization information WL. As a result, a result of decoding can be improved in quality as compared to the case where bits are distributed to only a specific spectrum and are not sufficiently distributed to adjacent spectra.

[Description of a Process Performed by the Noise Shaping Part]

Figure 10:
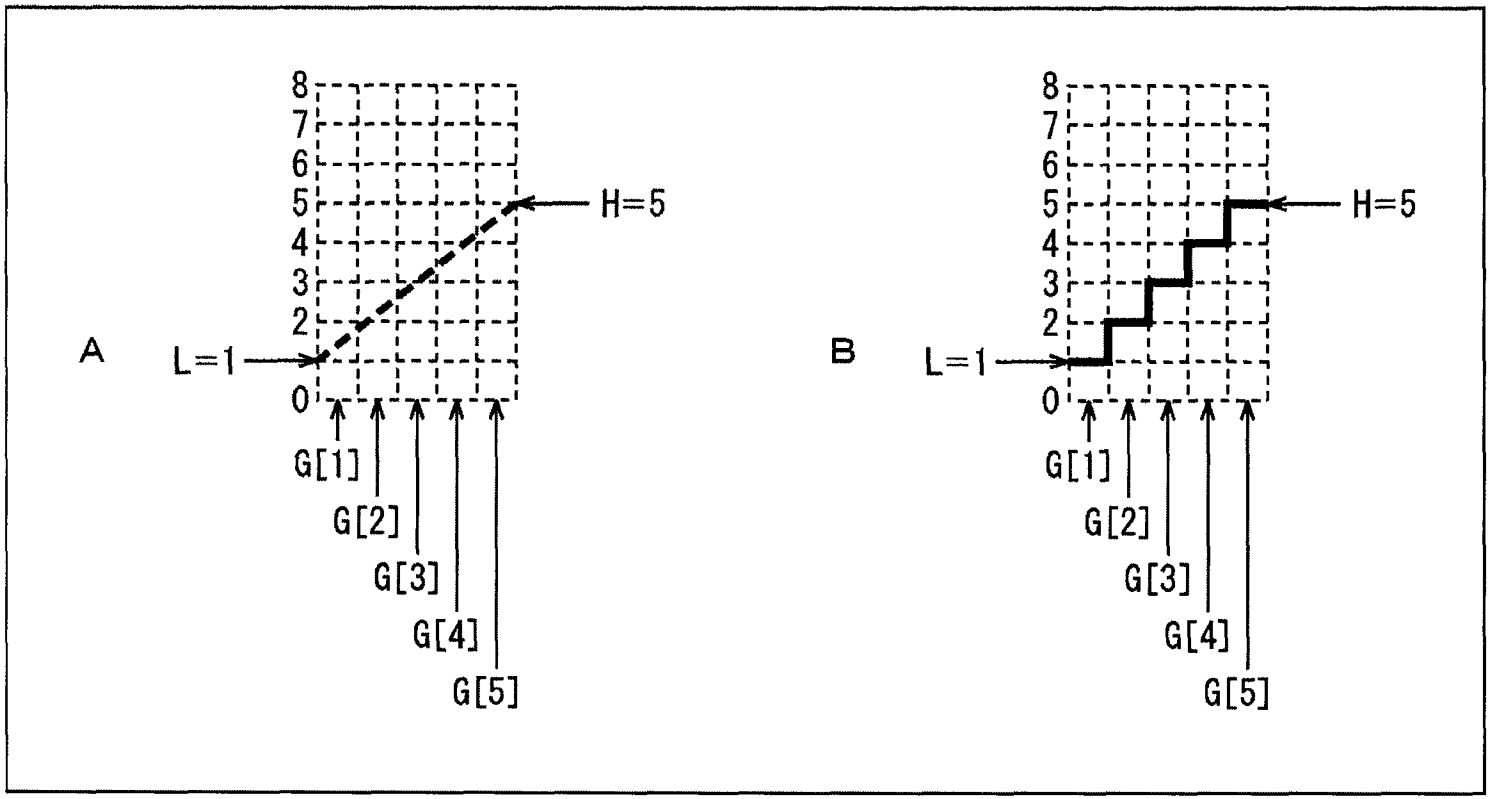
FIG. 10 is a diagram for describing a method for generating noise shaping by the noise shaping part shown in FIG. 9.

FIG. 10 is a diagram for describing a method for generating noise shaping G by the noise shaping part 52 shown in FIG. 9.

In the example shown in FIG. 10, the lowest value L is 1 and the highest value H is 5. The number of quantization units is 5.

As shown in FIG. 10A, the noise shaping generation part 92 first sets the lowest value L as noise shaping G[1] for a first quantization unit 1, and sets the highest value H as noise shaping G[5] for a last quantization unit 5. Then, the noise shaping generation part 92 obtains a straight line connecting the noise shaping G[1] for the first quantization unit 1 and the noise shaping G[5] for the last quantization unit 5. After that, the noise shaping generation part 92 quantizes the straight line to obtain noise shaping G[k] for each of the quantization units, as shown in FIG. 10B. In the example of FIG. 10B, the noise shaping G[1] to G[5] is 1, 2, 3, 4, and 5 in this order.

The straight line of the noise shaping G is quantized using a predetermined equation, for example. Alternatively, the straight line of the noise shaping G may be quantized such that a table is stored in advance in which quantization results and the information NS are associated and a quantization result corresponding to the information NS is read out from the table.

As shown in FIG. 10, if the noise shaping G[k] is generated so as to become larger for the quantization units with indexes of larger numbers, that is, at higher frequencies, the S/N ratio can be lowered at higher frequencies. Accordingly, it is possible to realize noise shaping corresponding to a human's aural characteristic that noise is less prone to be heard at higher frequencies.

Therefore, the encoding device 50 generates noise shaping G[k] so as to be larger at higher frequencies as shown in FIG. 10, thereby to reduce an amount of information of the quantized spectrum QS[k] and realize high-frequency encoding, without deteriorating quality of sounds perceived by users.

Figure 11:
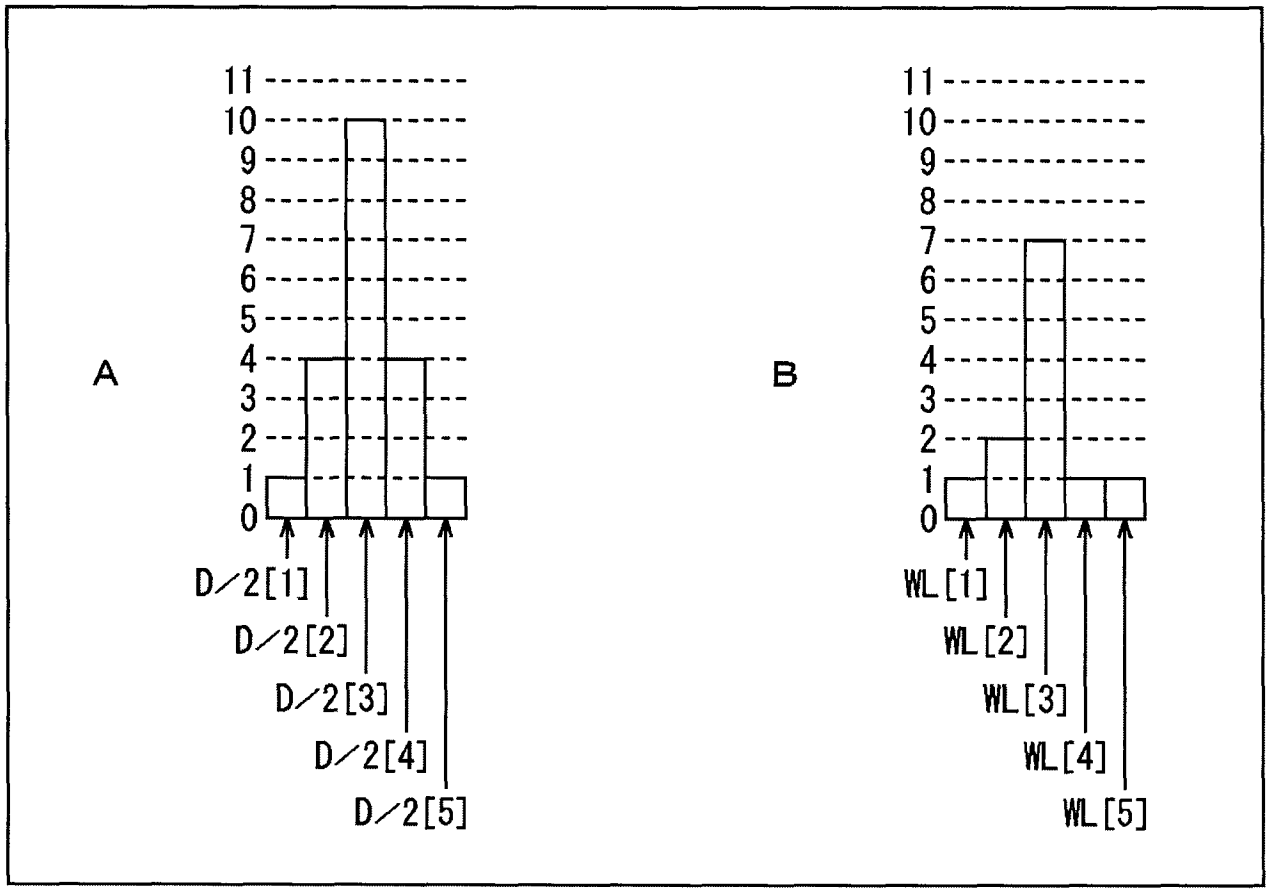
FIG. 11 is a diagram for describing a method for generating quantization information by the noise shaping part.

FIG. 11 is a diagram for describing a method for generating the quantization information WL by the noise shaping part 52.

If the emphasized envelopes D[i] to D[i+4] shown in FIG. 8C are supplied as emphasized envelopes D[1] to D[5] to the noise shaping part 52, the divided values D[1]/2 to D[5]/2 are 1, 4, 10, 4, and 1 in this order as shown in FIG. 11A. In the embodiment, values after the decimal point are discarded.

If the noise shaping G[1] to G[5] shown in FIG. 10 is generated by the noise shaping generation part 92, the quantization information WL[1] to WL[5] is 1, 2, 7, 1, and 1 in this order as shown in FIG. 11B. In the embodiment, if the quantization information WL[k] becomes smaller than 1, the quantization information WL[k] is set at 1.

Figure 12:
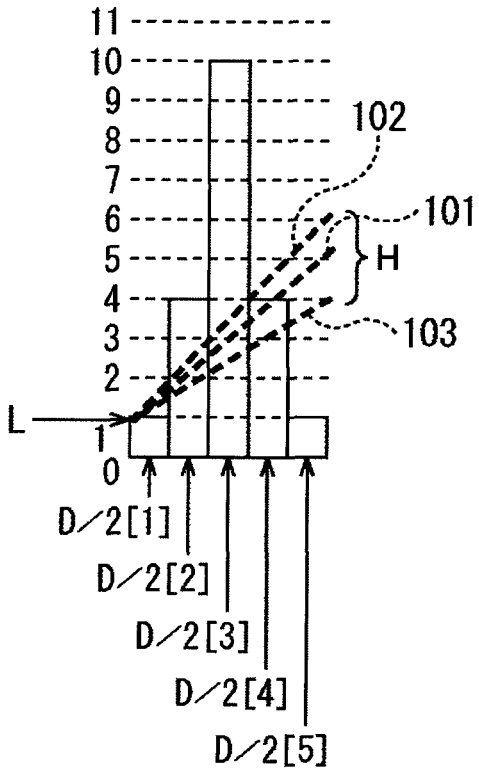
FIG. 12 is a diagram for describing an adjustment made to a bit count in a bit stream by the noise shaping part.

FIG. 12 is a diagram for describing adjustment of the bit count in the bit stream BS' by the noise shaping part 52.

As shown in FIG. 12, the bit count in the bit stream BS' can be adjusted by modifying the highest value H.

Specifically, if the lowest value L is 1 and the highest value H is 5, for example, the straight line of the noise shaping G prior to the quantization is a straight line 101. Meanwhile, if the lowest value L is 1 and the highest value H is 6, the straight line of the noise shaping G prior to the quantization is a straight line 102 with a larger inclination than the straight line 101. Therefore, the noise shaping G[k] becomes larger, and the quantization information WL[k] becomes smaller. Accordingly, the bit count in the bit stream BS' can be made smaller.

If the lowest value L is 1 and the highest value H is 4, the straight line of the noise shaping G prior to the quantization is a straight line 103 with a smaller inclination than the straight line 101. Therefore, the noise shaping G[k] becomes smaller and the quantization information WL[k] becomes larger. Accordingly, the bit count in the bit stream BS' can be made larger.

[Advantage of Emphasizing the Envelope]

Figure 13:
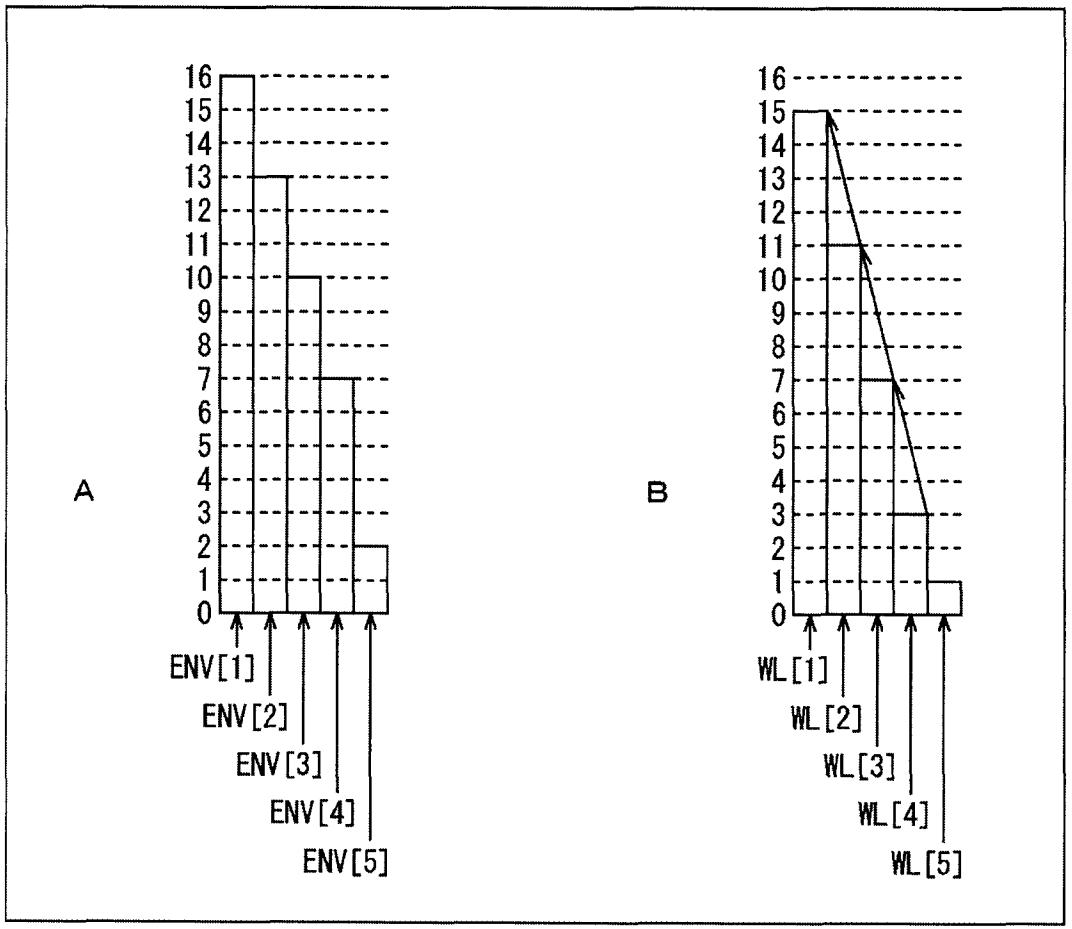
FIG. 13 is a diagram for describing an advantage of emphasizing envelopes.
Figure 14:
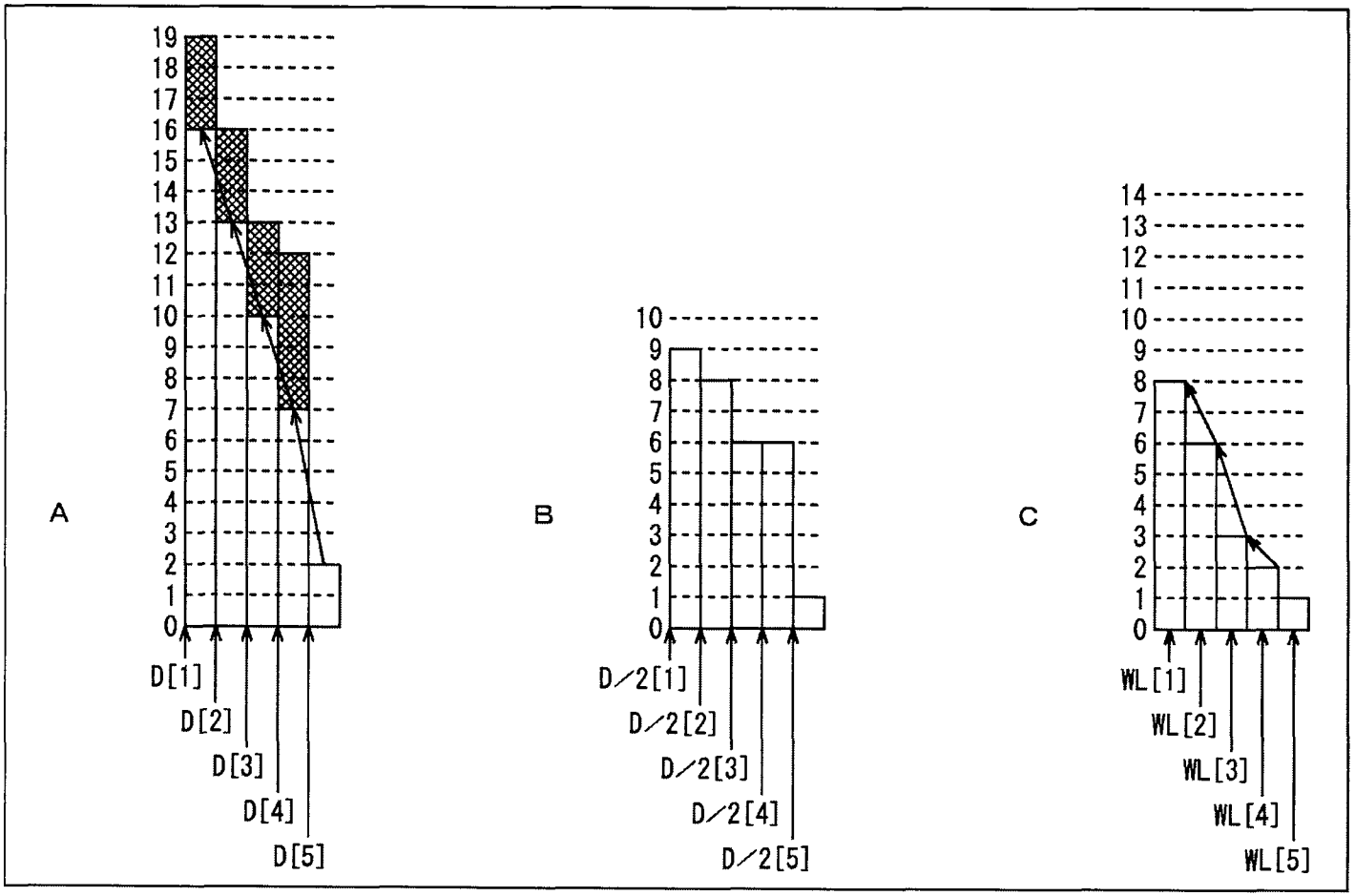
FIG. 14 is a diagram for describing an advantage of emphasizing envelopes.

FIGS. 13 and 14 are diagrams for describing advantages of emphasizing the envelopes ENV.

Referring to FIG. 13, the following description will be provided for the case where the envelopes ENV[1] to ENV[5] are 16, 13, 10, 7, and 2 in this order as shown in FIG. 13A. In this case, when the envelopes ENV[1] to ENV[5] are not emphasized but are used as they are for generation of the quantization information WL[1] to WL[5], if the values of the noise shaping G[1] to G[5] are as shown in FIG. 10B, for example, the quantization information WL[1] to WL[5] become 15, 11, 7, 3, and 1 as shown in FIG. 13B.

As in the foregoing, when the envelopes ENV[k] are used as they are for generation of the quantization information WL[k], the characteristic of a waveform of the envelopes ENV[k] influences on a waveform of the quantization information WL[k], a difference between the quantization information WL[k] of the adjacent quantization units becomes identical to a difference between the envelopes ENV[k]. Depending on a waveform of the noise shaping G[k], the difference between the quantization information WL[k] of the adjacent quantization units may be larger than the difference between the envelopes ENV[k].

In contrast to this, when the envelopes ENV[1] to ENV[5] shown in FIG. 13A are emphasized by the envelope emphasis part 51, the emphasized envelopes D[1] to D[5] become 19, 16, 13, 12, and 2 in this order as shown in FIG. 14A. Therefore, as shown in FIG. 14B, the divided values D[1]/2 to D[5]/2 becomes 9, 8, 6, 6, and 1 in this order as shown in FIG. 14B. If the values of the noise shaping G[1] to G[5] are as shown in FIG. 10B, the quantization information WL[1] to WL[5] become 8, 6, 3, 2, and 1 in this order as shown in FIG. 14C.

As in the foregoing, when the envelopes ENV[k] are emphasized and divided by 2 before being used for generation of the quantization information WL[k], the difference between the quantization information WL[k] for the adjacent quantization units becomes comparatively small. That is, the quantization information WL[k] for the quantization units is unified. As a result, a result of decoding can be improved in quality as compared to the case where bits are distributed to only a specific spectrum and are not sufficiently distributed to adjacent spectra.

[Description of a Process Performed by the Encoding Device]

Figure 15:
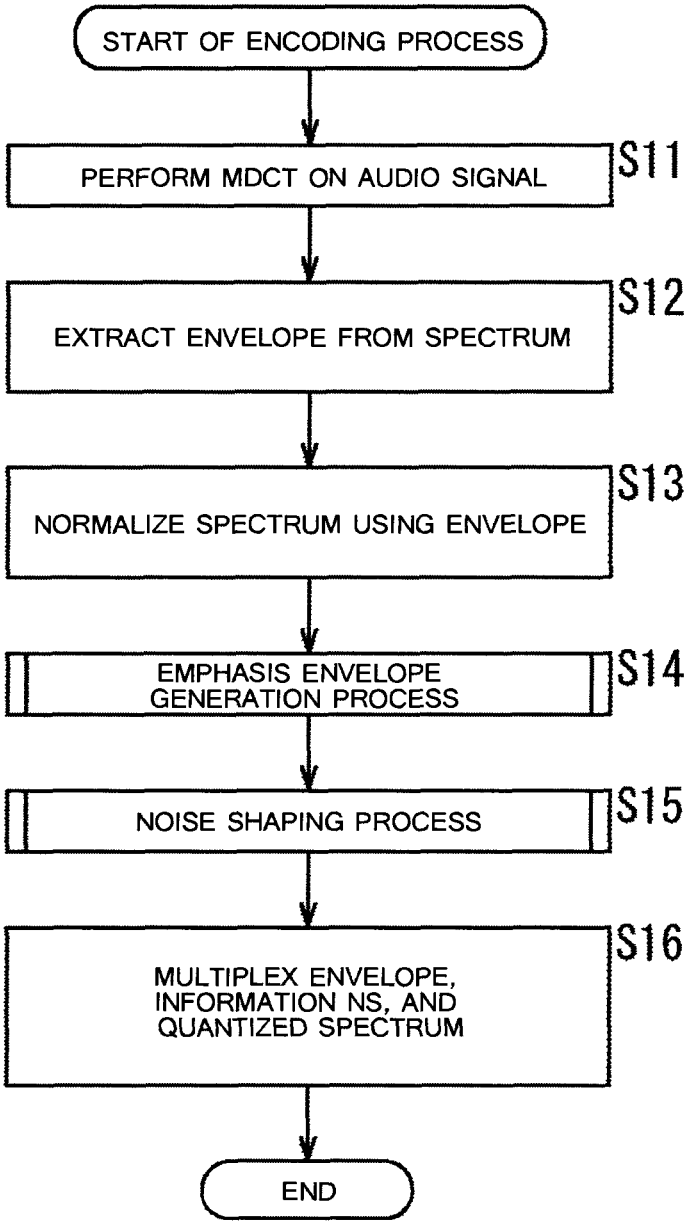
FIG. 15 is a flowchart for describing an encoding process performed by the encoding device shown in FIG. 5.

FIG. 15 is a flowchart for describing an encoding process performed by the encoding device 50 shown in FIG. 5. The encoding process is started when an audio signal is input into the encoding device 50, for example.

At step S11 shown in FIG. 15, the MDCT part 11 of the encoding device 50 performs MDCT on the input audio signal as a time domain signal, thereby to obtain a spectrum S0 as a frequency domain signal. The MDCT part 11 supplies the spectrum S0 to the normalization part 12.

At step S12, the normalization part 12 extracts envelopes ENV[k] by quantization unit from the spectrum S0, and supplies the same to the envelope emphasis part 51 and the multiplexing part 53.

At step S13, the normalization part 12 normalizes a spectrum S0[k] using the envelope ENV[k] for each of the quantization units, and supplies a resultant normalized spectrum S1[k] to the quantization part 14.

At step S14, the envelope emphasis part 51 performs an emphasized envelope generation process for generating emphasized envelopes D[k] using the envelopes ENV[k]. Details of the emphasized envelope generation process will be provided with reference to a flowchart shown in FIG. 16 described later.

At step S15, the noise shaping part 52 performs a noise shaping process in which the noise shaping G[k] is subtracted from a value obtained by dividing by 2 the emphasized envelopes D[k] generated by the emphasized envelope generation process at step S14. Details of the noise shaping process will be provided with reference to the flowchart shown in FIG. 17 described later.

At step S16, the multiplexing part 53 generates the bit stream BS' by multiplexing the envelopes ENV[k] supplied from the normalization part 12, the information NS supplied from the noise shaping part 52, and the quantized spectra QS[k] supplied from the quantization part 14. The multiplexing part 15 outputs the bit stream BS' as a result of encoding. Accordingly, the process is terminated.

Figure 16:
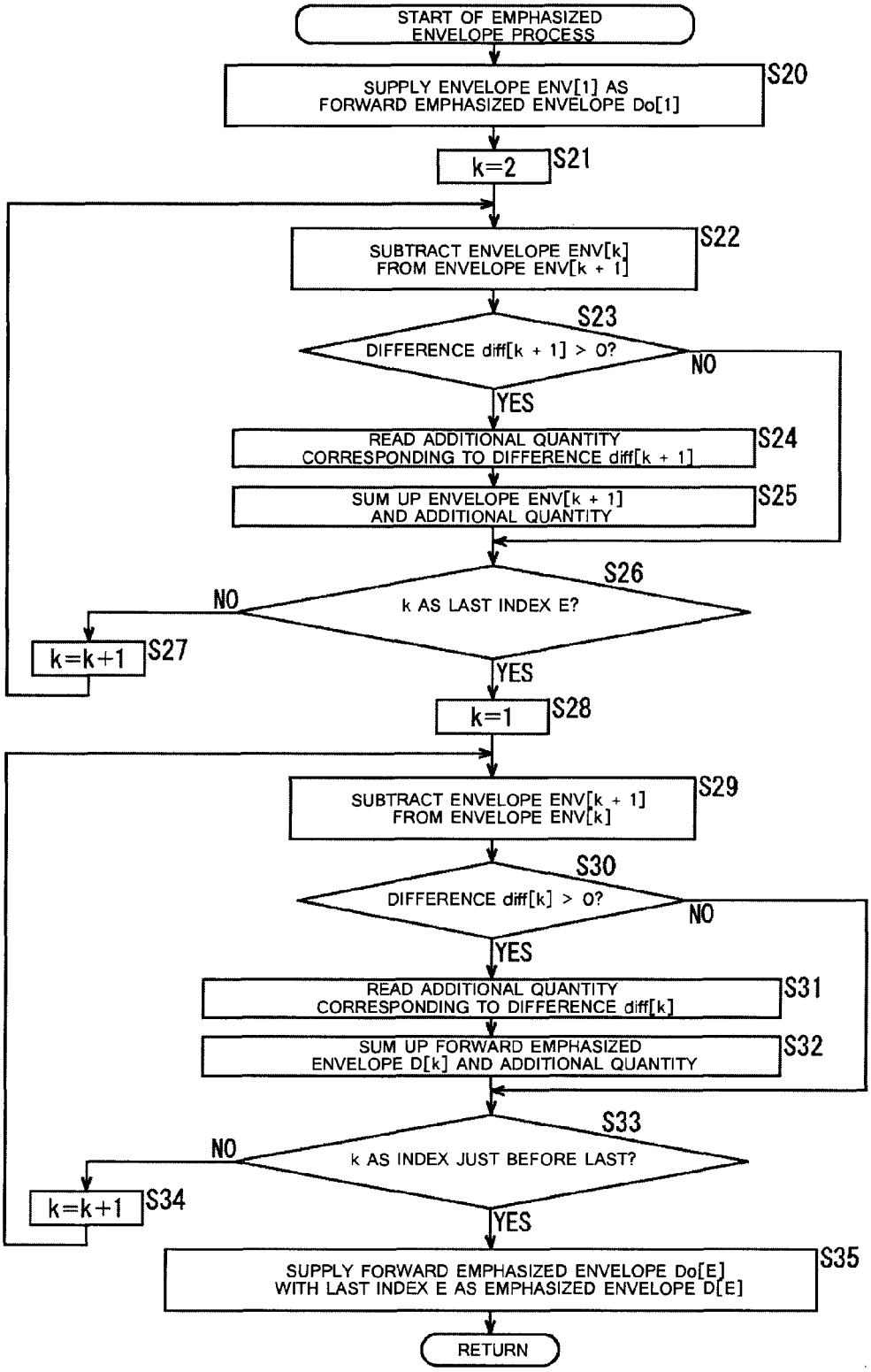
FIG. 16 is a flowchart for describing details of an emphasized envelope generation process at step S14 shown in FIG. 15.

FIG. 16 is a flowchart for describing details of the emphasized envelope generation process at step S14 shown in FIG. 15.

At step S20 shown in FIG. 16, the difference calculation part 71 (FIG. 7) of the forward emphasis part 61 of the envelope emphasis part 51 supplies the envelope ENV[1] for the quantization unit supplied from the normalization part 12 as it is as a forward emphasized envelope Do[1] to the backward emphasis part 62.

At step S21, the forward emphasis part 61 sets an index k to 2 for the envelopes ENV to be processed.

At step S22, the difference calculation part 71 of the forward emphasis portion 61 subtracts the envelope ENV[k] from the envelope ENV[k+1] supplied from the normalization part 12, thereby determining a difference diff[k+1]. The difference calculation part 71 supplies the determined difference diff[k+1] and the envelope ENV[k+1] to the adding part 72.

At step S23, the adding part 72 determines whether the difference diff[k+1] supplied from the difference calculation part 71 is larger than 0, that is, whether the difference diff[k+1] is a positive value. If determining at step S23 that the difference diff[k+1] is larger than 0, the adding part 72 reads an additional quantity corresponding to the difference diff[k+1] from the additional quantity table part 73 at step S24.

At step S25, the adding part 72 sums up the additional quantity read at step S24 and the envelope ENV[k+1], and supplies a resultant value as a forward emphasized envelope Do[k+1] to the backward emphasis part 62. Then, the process moves to step S26.

Meanwhile, if determining at step S23 that the difference diff[k+1] is not larger than 0, the adding part 72 supplies the envelope ENV[k+1] as it is as a forward emphasized envelope Do[k+1] to the backward emphasis part 62. Then, the process moves to step S26.

At step S26, the forward emphasis part 61 determines whether the index k for the envelopes ENV to be processed is a last index E, that is, whether the forward emphasized envelopes Do[k] for all the quantization units are supplied to the backward emphasis part 62.

If determining at step S26 that the index k for the envelopes ENV to be processed is not the last index E, the forward emphasis part 61 increments the index k by only 1 at step S27, and returns the process to step S22. Accordingly, the forward emphasis part 61 repeats steps S22 to S27 until the index k for the envelopes ENV to be processed becomes the last index E.

Meanwhile, if determining at step S26 that the index k for the envelopes ENV to be processed is the last index E, the backward emphasis part 62 sets at 1 the index k for the envelopes ENV to be processed, at step S28.

At step S29, the difference calculation part 81 of the backward emphasis part 62 subtracts the envelope ENV[k+1] from the envelope ENV[k] supplied from the normalization part 12, thereby determining a difference diff[k]. The difference calculation part 81 supplies the determined difference diff[k] to the adding part 82.

At step S30, the adding part 82 determines whether the difference diff[k] supplied from the difference calculation part 81 is larger than 0. If determining at step S30 that the difference diff[k] is larger than 0, at step S31, the adding part 82 reads an additional quantity corresponding to the difference diff[k] from the additional quantity table part 83.

At step S32, the adding part 82 sums up the forward emphasized envelope Do[k] supplied from the adding part 72 and the additional quantity read at step S30. The adding part 82 supplies a resultant value as an emphasized envelope D[k] to the noise shaping part 52 (FIG. 5). Then, the process moves to step S33.

In contrast, if determining at step S30 that the difference diff[k] is not larger than 0, the adding part 82 supplies the forward emphasized envelope Do[k] supplied from the adding part 72 as it is as an emphasized envelope D[k] to the noise shaping part 52. Then, the process moves to step S33.

At step S33, the backward emphasis part 62 determines whether the index k for the envelopes ENV to be processed is the index immediately preceding the last index. If determining at step S33 that the index k for the envelopes ENV to be processed is not the index immediately preceding the last index, the backward emphasis part 62 increments by 1 the index k for the envelopes ENV to be processed at step S34, and returns the process to step S29. Accordingly, the backward emphasis part 62 repeats steps S29 to S34 until the index k for the envelopes ENV to be processed becomes the index immediately preceding last index.

In contrast, if it is determined at step S33 that the index k for the envelopes ENV to be processed is the index immediately preceding the last index E, the process moves to step S35.

At step S35, the adding part 82 supplies the forward emphasized envelope Do[E] for the last index E as an emphasized envelope D[E] to the noise shaping part 52. Then, the process returns to step S14 shown in FIG. 15, and moves to step S15.

Figure 17:
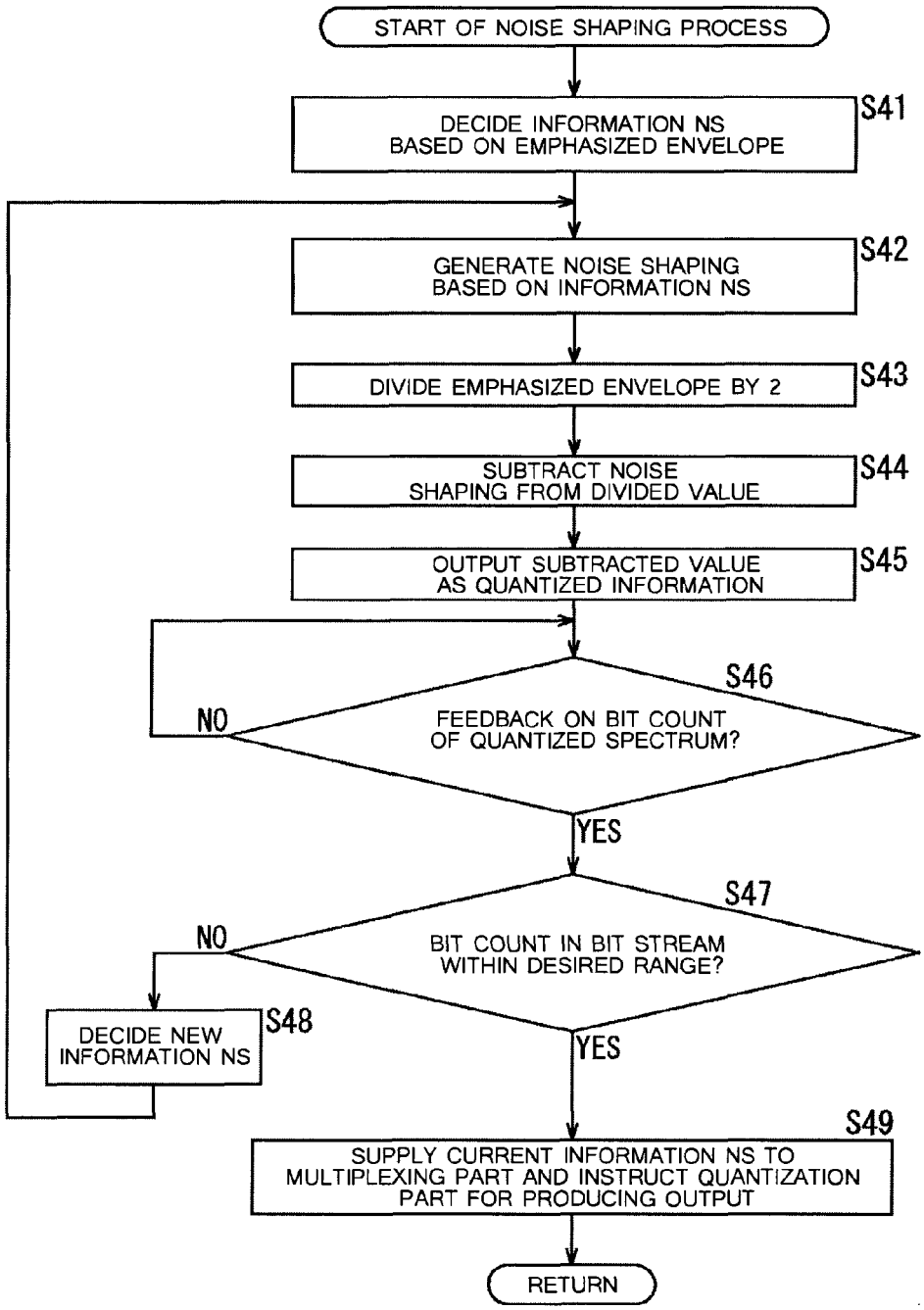
FIG. 17 is a flowchart for describing details of a noise shaping process at step S15 shown in FIG. 15.

FIG. 17 is a flowchart for describing details of the noise shaping process at step S15 shown in FIG. 15.

At step S41 shown in FIG. 17, the NS decision part 91 (FIG. 9) of the noise shaping part 52 decides information NS such that the bit count in the bit stream BS' falls within a desired range, based on the emphasized envelope D[k] supplied from the envelope emphasis part 51 shown in FIG. 5. The NS decision part 91 supplies the information NS to the noise shaping generation part 92.

At step S42, the noise shaping generation part 92 generates noise shaping G[k] based on the information NS supplied from the NS decision part 91. Then, the noise shaping generation part 92 supplies the generated noise shaping G[k] to the subtraction part 94.

At step S43, the division part 93 divides by 2 the emphasized envelope D[k] supplied from the envelope emphasis part 51 shown in FIG. 5, and supplies a resultant divided value D[k]/2 to the subtraction part 94.

At step S44, the subtraction part 94 subtracts the noise shaping G[k] supplied from the noise shaping generation part 92, from the divided value D[k]/2 supplied from the division part 93.

At step S45, the subtraction part 94 outputs a subtracted value resulting from step S44 as quantization information WL[k], to the quantization part 14 (FIG. 5).

At step S46, the NS decision part 91 determines whether there is feedback from the quantization part 14 on the bit count N in the quantized spectrum QS[k] quantized according to the quantization information WL output at step S45.

If determining at step S46 that there is no feedback from the quantization part 14 on the bit count N, the NS decision part 91 waits for feedback on the bit count N.

In contrast, if determining at step S46 that there is feedback from the quantization part 14 on the bit count N, the NS decision part 91 determines based on the bit count N at step S47 that the bit count in the bit stream BS' falls under a desired range.

If determining at step S47 that the bit count in the bit stream BS' does not fall within a desired range, the NS decision part 91 decides new information NS such that the bit count in the bit stream BS' falls within a desired range, at step S48. Then, the NS decision part 91 supplies the decided information NS to the noise shaping generation part 92, and returns the process to step S42.

The NS decision part 91 repeats steps S42 to S48 until the bit count in the bit stream BS' falls within a desired range.

In contrast, if determining at step S47 that the bit count in the bit stream BS' falls within a desired range, the NS decision part 91 supplies the current information NS to the multiplexing part 53 (FIG. 5) and instructs the quantization part 14 for producing an output, at step S49. Then, the process returns to step S15 shown in FIG. 15 and moves to step S16.

[Configuration Example of a Decoding Device]

Figure 18:
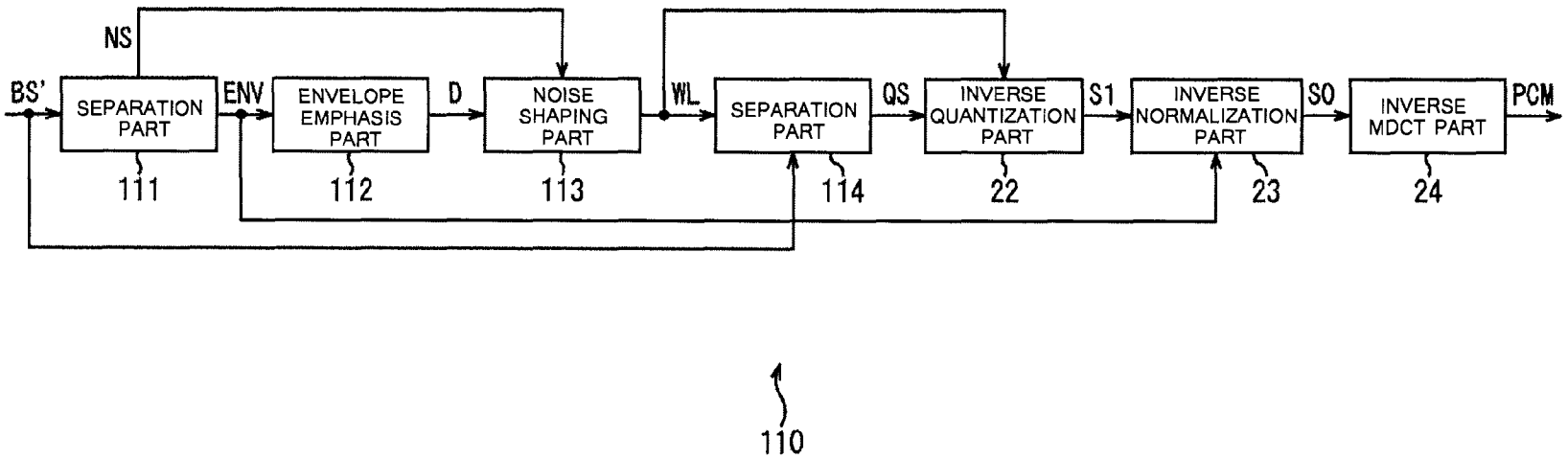
FIG. 18 is a block diagram showing a configuration example of a decoding device that decodes the bit stream encoded by the encoding device shown in FIG. 5.

FIG. 18 is a block diagram showing a configuration example of a decoding device decoding the bit stream BS' encoded by the encoding device 50 shown in FIG. 5.

Figure 4:
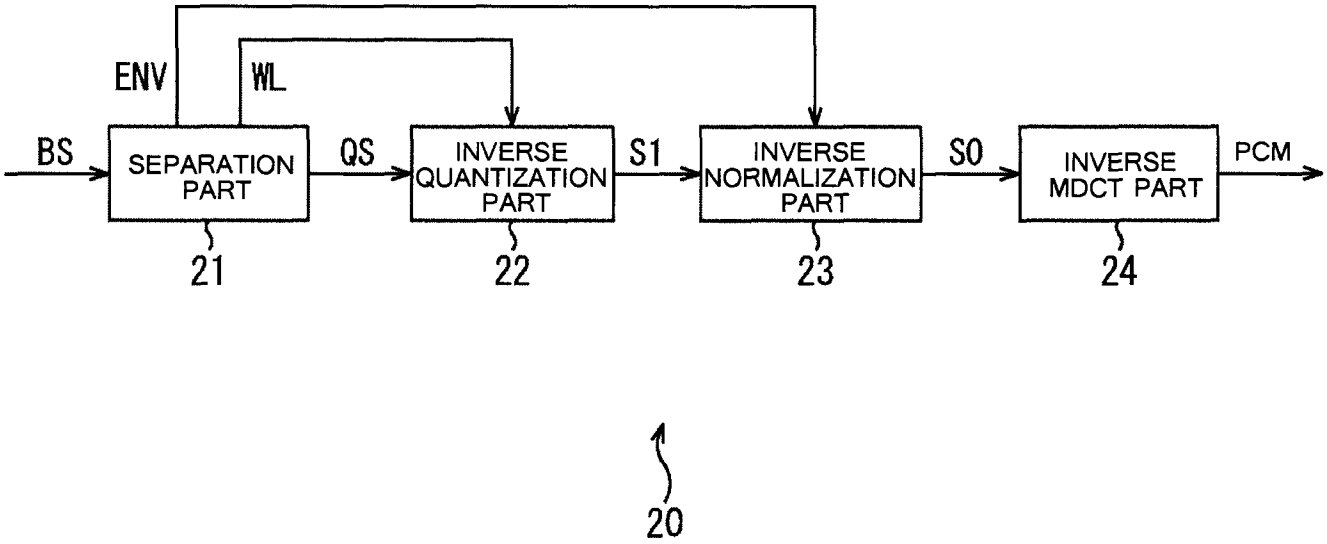
FIG. 4 is a block diagram showing a configuration example of a decoding device that decodes a result of encoding by the encoding device shown in FIG. 1.

In the configuration shown in FIG. 18, the same components as those in the configuration of FIG. 4 are given the same reference numerals as those in the configuration of FIG. 4. Duplicated descriptions on the same components are omitted as appropriate.

The configuration of a decoding device 110 shown in FIG. 18 is different from the configuration of FIG. 4, mainly in that a separation part 111, an envelope emphasis part 112, a noise shaping part 113, and a separation part 114, are provided in place of the separation part 21.

The bit stream BS' encoded by the encoding device 50 is input into the separation part 111 of the decoding device 110. The separation part 111 separates the envelopes ENV[k] by quantization unit and the information NS from the bit stream BS'. The separation part 111 supplies the envelopes ENV[k]

to the envelope emphasis part 112 and the inverse normalization part 23, and supplies the information NS to the noise shaping part 113.

The envelope emphasis part 112 is configured in the same manner as with the envelope emphasis part 51 shown in FIG. 7. The envelope emphasis part 112 generates the emphasized envelopes D[k] by quantization unit using the envelopes ENV [k] by quantization unit supplied from the separation part 111, and supplies the same to the noise shaping part 113.

The noise shaping part 113 divides by 2 the emphasized envelopes D[k] by quantization unit supplied from the envelope emphasis part 112. Then, the noise shaping part 113 subtracts the noise shaping G[k] specified by the information NS supplied from the separation part 111, from a divided value for each of the quantization units. The noise shaping part 52 supplies a resultant value as quantization information WL[k] to the separation part 114 and the inverse quantization part 22. Details of the noise shaping part 113 will be provided with reference to FIG. 19 described later.

The separation part 114 separates the quantized spectrum QS[k] from the bit stream BS' input from the encoding device 50, based on the quantization information WL[k] supplied from the noise shaping part 113. The separation part 114 supplies the quantized spectrum QS[k] to the inverse quantization part 22.

[Detailed Configuration Example of the Noise Shaping Part]

Figure 19:
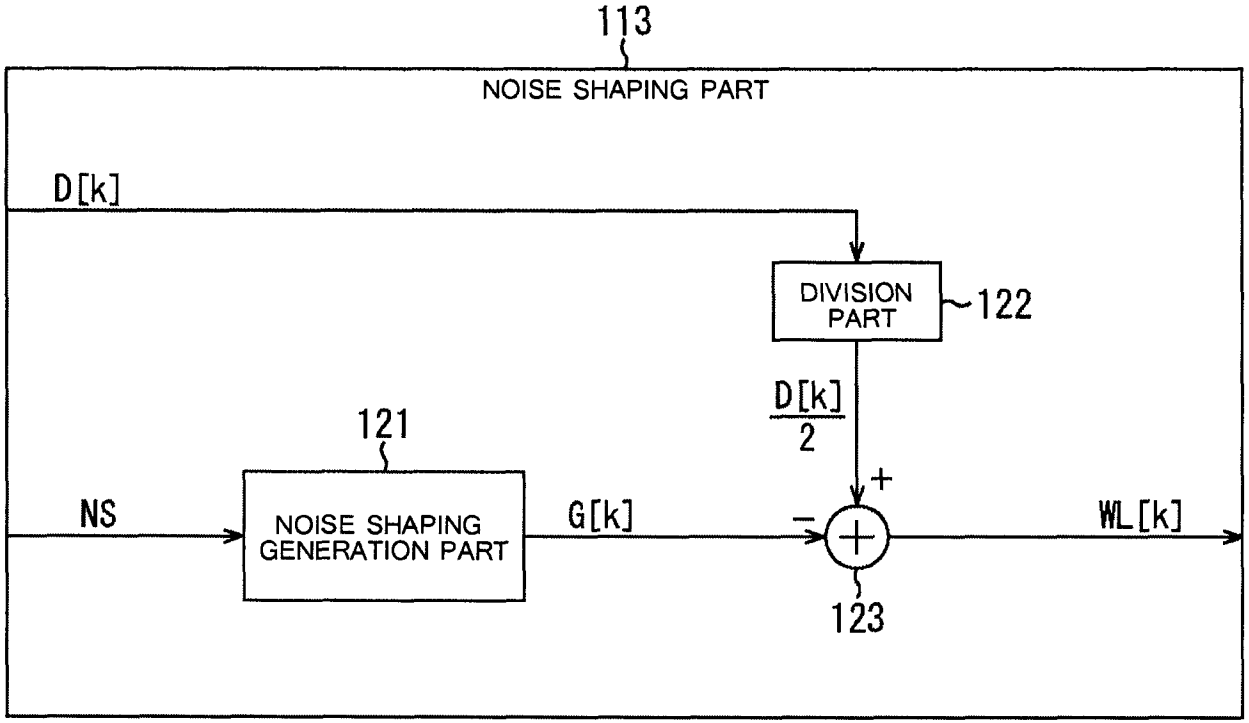
FIG. 19 is a block diagram showing a detailed configuration example of a noise shaping part shown in FIG. 18.

FIG. 19 is a block diagram showing a detailed configuration example of the noise shaping part 113 shown in FIG. 18.

As shown in FIG. 19, the noise shaping part 113 is formed by a noise shaping generation part 121, a division part 122, and a subtraction part 123.

The noise shaping generation part 121 generates noise shaping G[k] for each of the quantization units, as with the noise shaping generation part 92 shown in FIG. 9, based on the information NS supplied from the separation part 111 shown in FIG. 18. Then, the noise shaping generation part 121 supplies the generated noise shaping G[k] to the subtraction part 123.

The division part 122 divides the emphasized envelope D[k] for each of the quantization units supplied from the envelope emphasis part 112 shown in FIG. 18 by 2, and supplies a resultant divided value D[k]/2 to the subtraction part 123.

The subtraction part 123 subtracts the noise shaping G[k] supplied from the noise shaping generation part 121, from the divided value D[k]/2 supplied from the division part 122, for each of the quantization units. The subtraction part 123 supplies a resultant subtracted value for each of the quantization units as quantization information WL[k] to the separation part 114 (FIG. 18).

[Description of a Process Performed by the Decoding Device]

Figure 20:
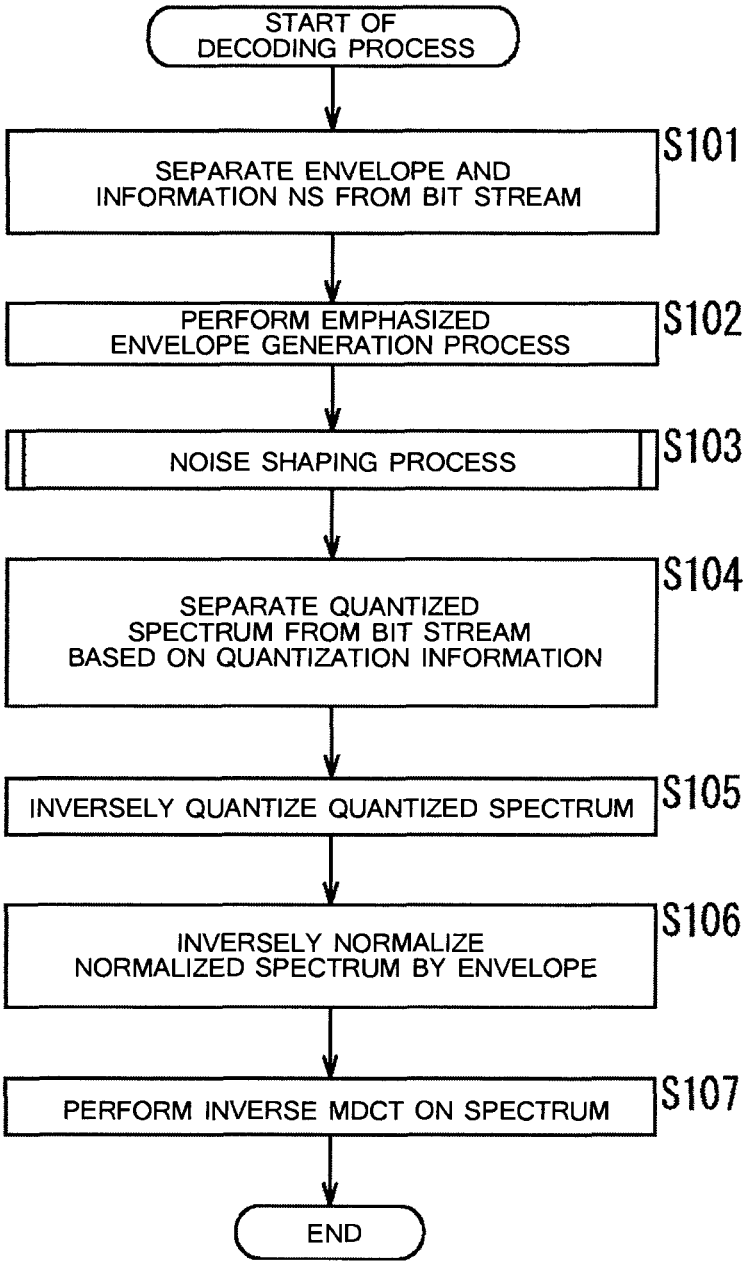
FIG. 20 is a flowchart for describing a decoding process performed by the decoding device shown in FIG. 18.

FIG. 20 is a flowchart for describing a decoding process performed by the decoding device 110 shown in FIG. 18. The decoding process is started when the bit stream BS' is input from the encoding device 50 shown in FIG. 5, for example.

At step S101 shown in FIG. 20, the separation part 111 (FIG. 18) of the decoding device 110 separates the envelope ENV[k] by quantization unit and the information NS, from the bit stream BS' input from the encoding device 50. The separation part 111 supplies the envelope ENV to the envelope emphasis part 112 and the inverse normalization part 23, and supplies the information NS to the noise shaping part 113.

At step S102, the envelope emphasis part 112 performs an emphasized envelope generation process for generating an emphasized envelope D[k] by quantization unit, using the envelope ENV[k] by quantization unit supplied from the separation part 111. The emphasized envelope generation process is the same as the emphasized envelope generation process shown in FIG. 16, and thus a description thereof will be omitted here. The emphasized envelope D[k] generated by the emphasized envelope generation process is supplied to the noise shaping part 113.

At step S103, the noise shaping part 113 performs a noise shaping process for subtracting the noise shaping G[k] from the emphasized envelope D[k] by quantization unit supplied from the envelope emphasis part 112. Details of the noise shaping process will be provided with reference to a flowchart shown in FIG. 21 described later.

At step S104, the separation part 114 separates a quantized spectrum QS[k] from the bit stream BS' input from the encoding device 50, based on the quantization information WL[k] supplied from the noise shaping part 113 at step S103. The separation part 114 supplies the quantized spectrum QS[k] to the inverse quantization part 22.

At step S105, the inverse quantization part 22 inversely quantizes the quantized spectrum QS[k] based on the quantization information WL supplied from the separation part 114, and supplies a resultant normalized spectrum S1[k] to the inverse normalization part 23.

At step S106, the inverse normalization part 23 inversely normalizes the normalized spectrum S1[k] supplied from the inverse quantization part 22 by the envelope ENV[k] supplied from the separation part 111, and supplies a resultant spectrum S0 to the inverse MDCT part 24.

At step S107, the inverse MDCT part 24 performs inverse MDCT on the spectrum S0 as a frequency domain signal supplied from the inverse normalization part 23, thereby obtaining a sound PCM signal as a time domain signal. The inverse MDCT part 24 outputs the sound PCM signal as an audio signal, and then terminates the process.

Figure 21:
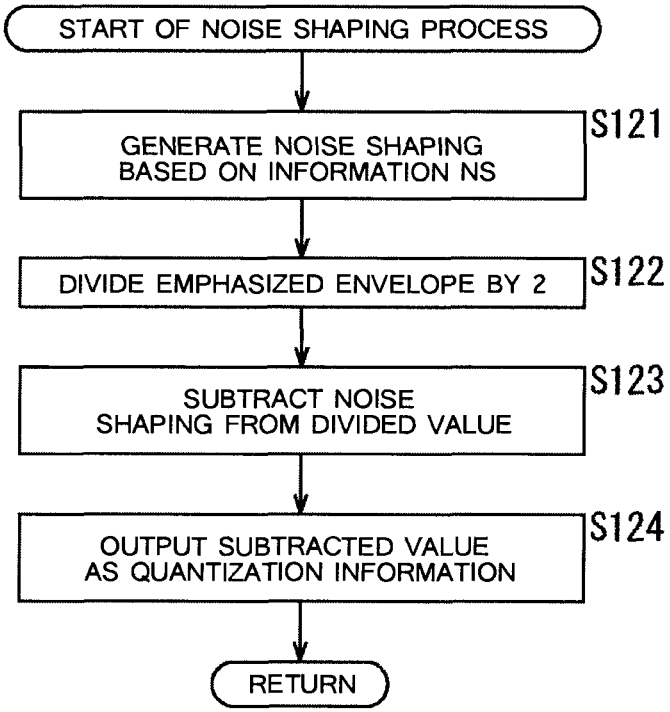
FIG. 21 is a flowchart for describing a noise shaping process at step S103 shown in FIG. 20.

FIG. 21 is a flowchart for describing the noise shaping process at step S103 shown in FIG. 20.

At step S121, the noise shaping generation part 121 (FIG. 19) of the noise shaping part 113 generates noise shaping G[k] based on the information NS supplied from the separation part 111 shown in FIG. 18. Then, the noise shaping generation part 121 supplies the generated noise shaping G[k] to the subtraction part 123.

At step S122, the division part 122 divides by 2 the emphasized envelope D[k] supplied from the envelope emphasis part 112 shown in FIG. 18, and supplies a resultant divided value D[k]/2 to the subtraction part 123.

At step S123, the subtraction part 123 subtracts the noise shaping G[k] supplied from the noise shaping generation part 121, from the divided value D[k]/2 supplied from the division part 122.

At step S124, the subtraction part 123 supplies a subtracted value resulting from step S123 as quantization information WL[k] to the separation part 114 (FIG. 18). Then, the process returns to step S103 shown in FIG. 20 and moves to step S104.

Second Embodiment

Configuration Example of a Second Embodiment of the Encoding Device

Figure 22:
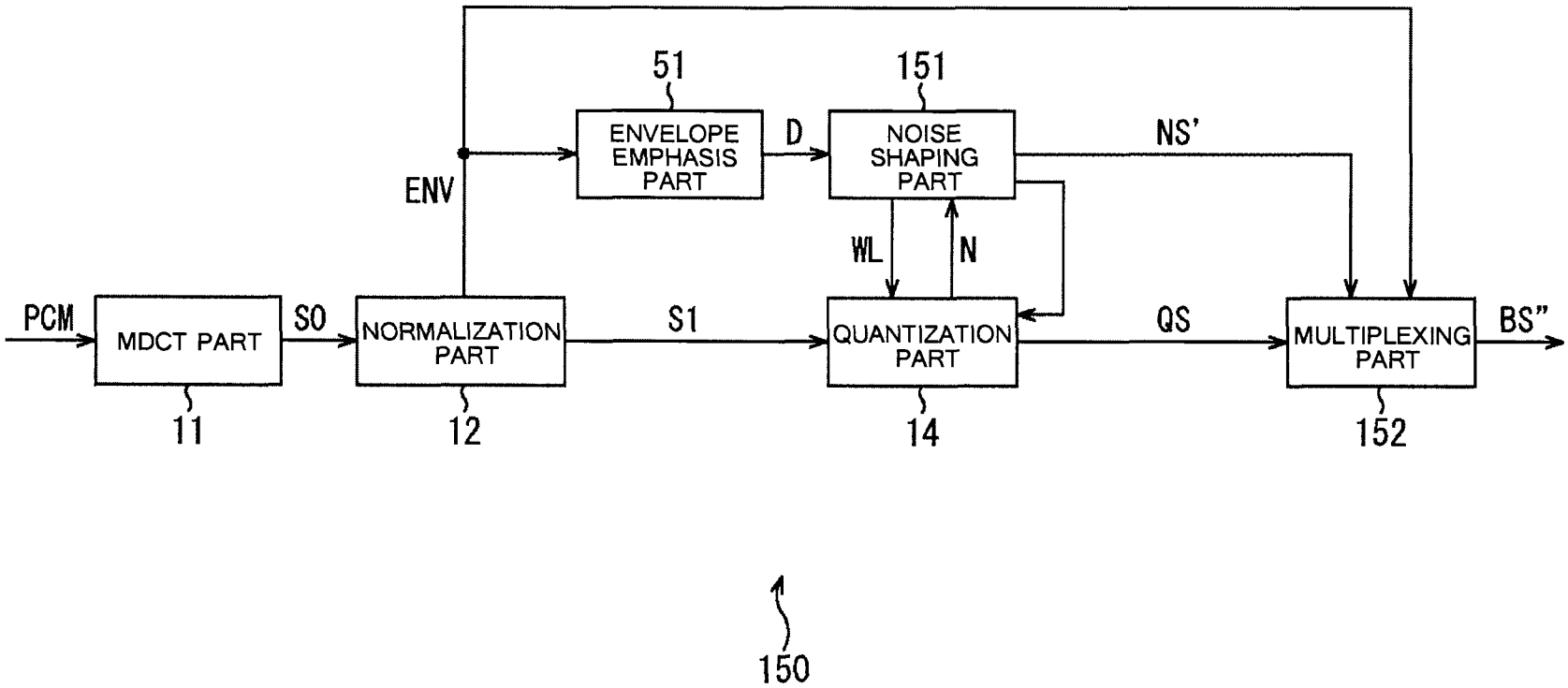
FIG. 22 is a block diagram showing a configuration example of a second embodiment of a display device to which the invention is applied.

FIG. 22 is a block diagram showing a configuration example of a second embodiment of a display device to which the invention is applied.

In the configuration shown in FIG. 22, the same components as those in the configuration of FIG. 5 are given the same reference numerals as those in the configuration of FIG. 5. Duplicated descriptions on the same components will be omitted as appropriate.

The configuration of the encoding device 150 shown in FIG. 22 is different from the configuration shown in FIG. 5, mainly in that a noise shaping part 151 and a multiplexing part 152 are provided in place of the noise shaping part 52 and the multiplexing part 53. The encoding device 150 has a plurality of kinds of arithmetic operations for quantization information WL, and includes arithmetic information P indicative of a used arithmetic operation together with the information NS as information NS', in a result of encoding.

Specifically, the noise shaping part 151 of the encoding device 150 determines quantization information WL[k] by a predetermined arithmetic operation, using the emphasized envelope D[k] by quantization unit supplied from the envelope emphasis part 51 and noise shaping G[k] by quantization unit specified by the information NS.

In addition, if the emphasized envelope D[k] is supplied from the envelope emphasis part 51, the noise shaping part 151 selects one from among a plurality of arithmetic operations for the quantization information WL, based on the emphasized envelope D[k] and a desired range of the bit count in a bit stream BS" generated by the multiplexing part 152. In addition, the noise shaping part 151 sets an initial value of the information NS preset in association with the selected arithmetic operation, as current information NS.

Further, if there is feedback from the quantization part 14 on the bit count N in the quantized spectrum QS[k] resulting from quantization of the normalized spectrum S1 based on the previous quantization information WL, the noise shaping part 151 determines whether the bit count in the bit stream BS" falls within a desired range according to the bit count N. If determining that the bit count in the bit stream BS" does not fall within a desired range, the noise shaping part 151 updates the information NS such that the bit count in the bit stream BS" falls within a desired range. Accordingly, the quantization part 14 is supplied with new quantization information WL.

In contrast, if determining that the bit count in the bit stream BS" falls within a desired range, the noise shaping part 151 instructs the quantization part 14 for producing an output, and supplies the current information NS and the arithmetic information P indicative of an arithmetic operation for the quantization information WL as information NS' to the multiplexing part 152.

The multiplexing part 152 multiplexes the envelopes ENV[k] supplied from the normalization part 12, the information NS' supplied from the noise shaping part 151, and the quantized spectrum QS[k] supplied from the quantization part 14, thereby generating the bit stream BS". The multiplexing part 152 outputs the bit stream BS" as a result of encoding.

[Configuration Example of the Bit Stream]

FIG. 23 is a diagram showing a configuration example of the bit stream BS" generated by the multiplexing part 152 shown in FIG. 22.

As shown in FIG. 23, the bit stream BS" is formed by a header Header including an upper limit value of a spectrum, an envelope ENV[k], information NS', and a quantized spectrum QS[k].

[Detailed Configuration Example of the Noise Shaping Part]

Figure 24:
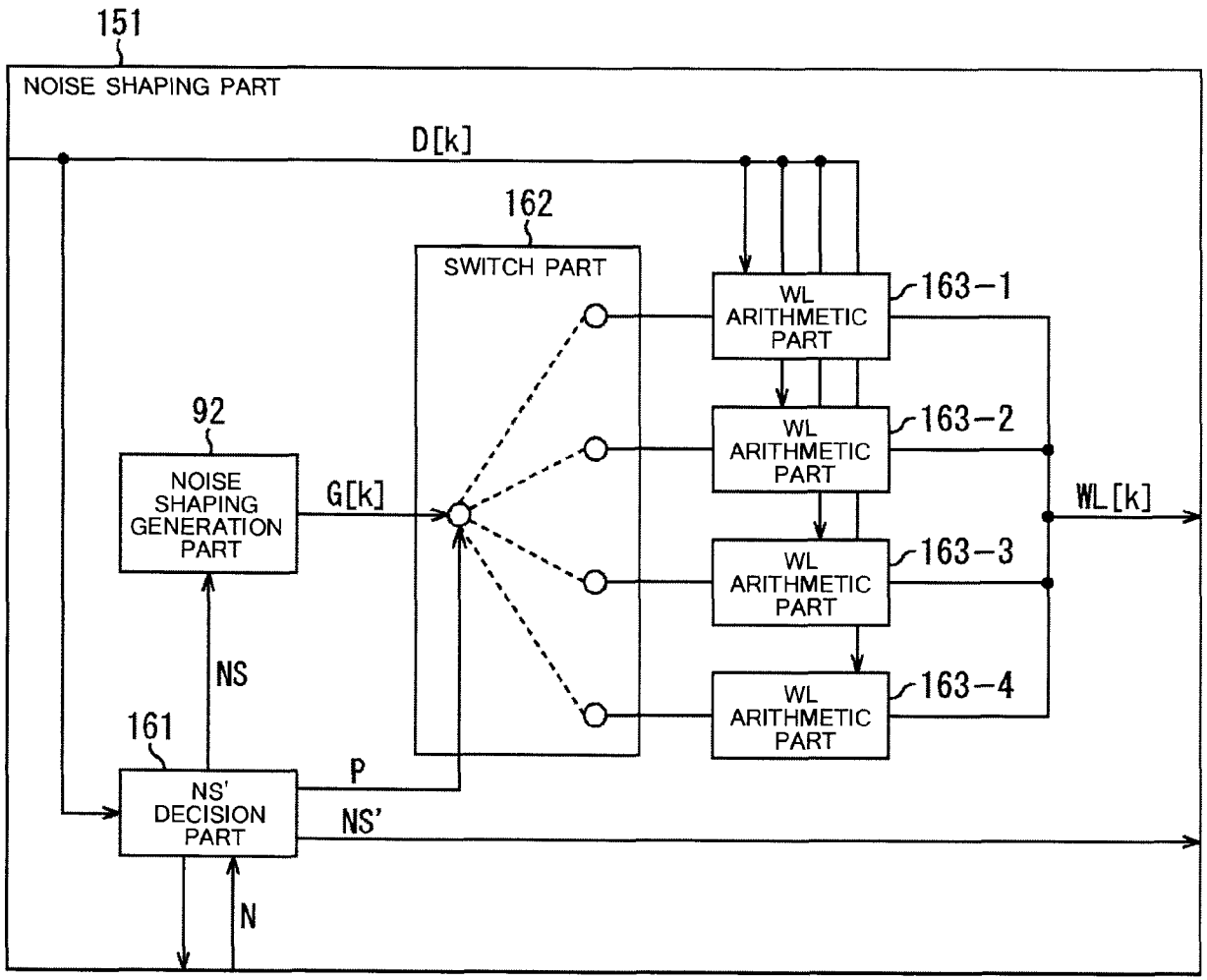
FIG. 24 is a block diagram showing a detailed configuration example of the noise shaping part shown in FIG. 22.

FIG. 24 is a block diagram showing a detailed configuration example of the noise shaping part 151 shown in FIG. 22.

In the configuration shown in FIG. 24, the same components as those in the configuration of FIG. 9 are given the same reference numerals as those in the configuration of FIG. 9. Duplicated descriptions on the same components will be omitted as appropriate.

The configuration of the noise shaping part 151 shown in FIG. 24 is different from the configuration of FIG. 9, mainly in that an NS' decision part 161 is provided in place of the NS decision part 91, a switch part 162 is newly provided, and WL arithmetic parts 163-1 to 163-4 are provided in place of the division part 93 and the subtraction part 94.

If the emphasized envelope D[k] for each of the quantization units is supplied from the envelope emphasis part 51 shown in FIG. 22, the NS' decision part 161 of the noise shaping part 151 selects one of arithmetic operations for quantization information WL corresponding to the WL arithmetic parts 163-1 to 163-4, based on the emphasized envelope D[k] and a desired range of the bit count in the bit stream BS". Then, the NS' decision part 161 supplies the arithmetic information P indicative of the selected arithmetic operation to the switch part 162. In addition, the NS' decision part 161 decides an initial value of the information NS preset in association with the arithmetic operation indicative of the arithmetic information P as current information NS, and supplies the same to the noise shaping generation part 92.

Further, if there is feedback from the quantization part 14 shown in FIG. 22 on the bit count N for the quantized spectrum QS[k] quantized based on the previous information NS and the quantization information WL specified by the arithmetic information P, the NS' decision part 161 determines whether the bit count in the bit stream BS" falls within a desired range based on the bit count N. If determining that the bit count in the bit stream BS" does not fall within a desired range, the NS' decision part 161 newly decides information NS so that the bit count in the bit stream BS" falls within the desired range and supplies the same to the noise shaping generation part 92.

In contrast, if determining that the bit count in the bit stream BS" falls within a desired range, the NS' decision part 161 supplies the current information NS and the arithmetic information P as information NS' to the multiplexing part 152 (FIG. 22), and instructs the quantization part 14 for producing an output.

As in the foregoing, the NS' decision part 161 performs rough control on the bit stream BS" by selection of the arithmetic operation on the quantization information WL, and then performs fine control by the information NS. If the bit count N is fed back from the quantization part 14, not only the information NS but also the arithmetic information P may be updated based on the bit count N.

Based on the arithmetic information P supplied from the NS' decision part 161, the switch part 162 (selection means) selects the WL arithmetic part for determining the quantization information WL by the arithmetic operation indicated by the arithmetic information P, from among the WL arithmetic parts 163-1 to 163-4. The switch part 162 supplies noise shaping G[k] generated by the noise shaping generation part 92 to the selected one of the WL arithmetic parts 163-1 to 163-4 for execution of the arithmetic operation.

The WL arithmetic part 163-1 subtracts the noise shaping G[k] supplied from the switch part 162, from the emphasized envelope D[k] supplied from the envelope emphasis part 51 shown in FIG. 22, and sets a resultant subtracted value as quantization information WL[k]. That is, the WL arithmetic part 163-1 determines the quantization information WL[k] by the arithmetic operation WL[k]=D[k]−G[k]. The WL arithmetic part 163-1 supplies the quantization information WL[k] to the quantization part 14 (FIG. 22).

The WL arithmetic part 163-2 has the division part 93 and the subtraction part 94 shown in FIG. 9. The WL arithmetic part 163-2 divides by 2 the emphasized envelope D[k] supplied from the envelope emphasis part 51. Then, the WL arithmetic part 163-2 subtracts the noise shaping G[k] supplied from the switch part 162, from a resultant divided value, and sets a subtracted value as quantization information WL[k]. That is, the WL arithmetic part 163-2 determines the quantization information WL[k] by the arithmetic operation WL[k]=D[k]/2−G[k]. The WL arithmetic part 163-2 supplies the quantization information WL[k] to the quantization part 14.

The WL arithmetic part 163-3 divides by 3 the emphasized envelope D[k] supplied from the envelope emphasis part 51. Then, the WL arithmetic part 163-3 subtracts the noise shaping G[k] supplied from the switch part 162, from a resultant divided value, and sets a resultant subtracted value as quantization information WL[k]. That is, the WL arithmetic part 163-3 determines the quantization information WL[k] by the arithmetic operation WL[k]=D[k]/3−G[k]. The WL arithmetic part 163-3 supplies the quantization information WL[k] to the quantization part 14.

The WL arithmetic part 163-4 divides by 4 the emphasized envelope D[k] supplied from the envelope emphasis part 51. The WL arithmetic part 163-4 subtracts the noise shaping G[k] supplied from the switch part 162, from a resultant divided value, and sets a resultant subtracted values as quantization information WL[k]. That is, the WL arithmetic part 163-4 generates the quantization information WL[k] by the arithmetic operation WL[k]=D[k]/4−G[k]. The WL arithmetic part 163-4 supplies the quantization information WL[k] to the quantization part 14.

[Advantages of Preparing a Plurality of Kinds of Arithmetic Operations for Quantization Information]

Figure 25:
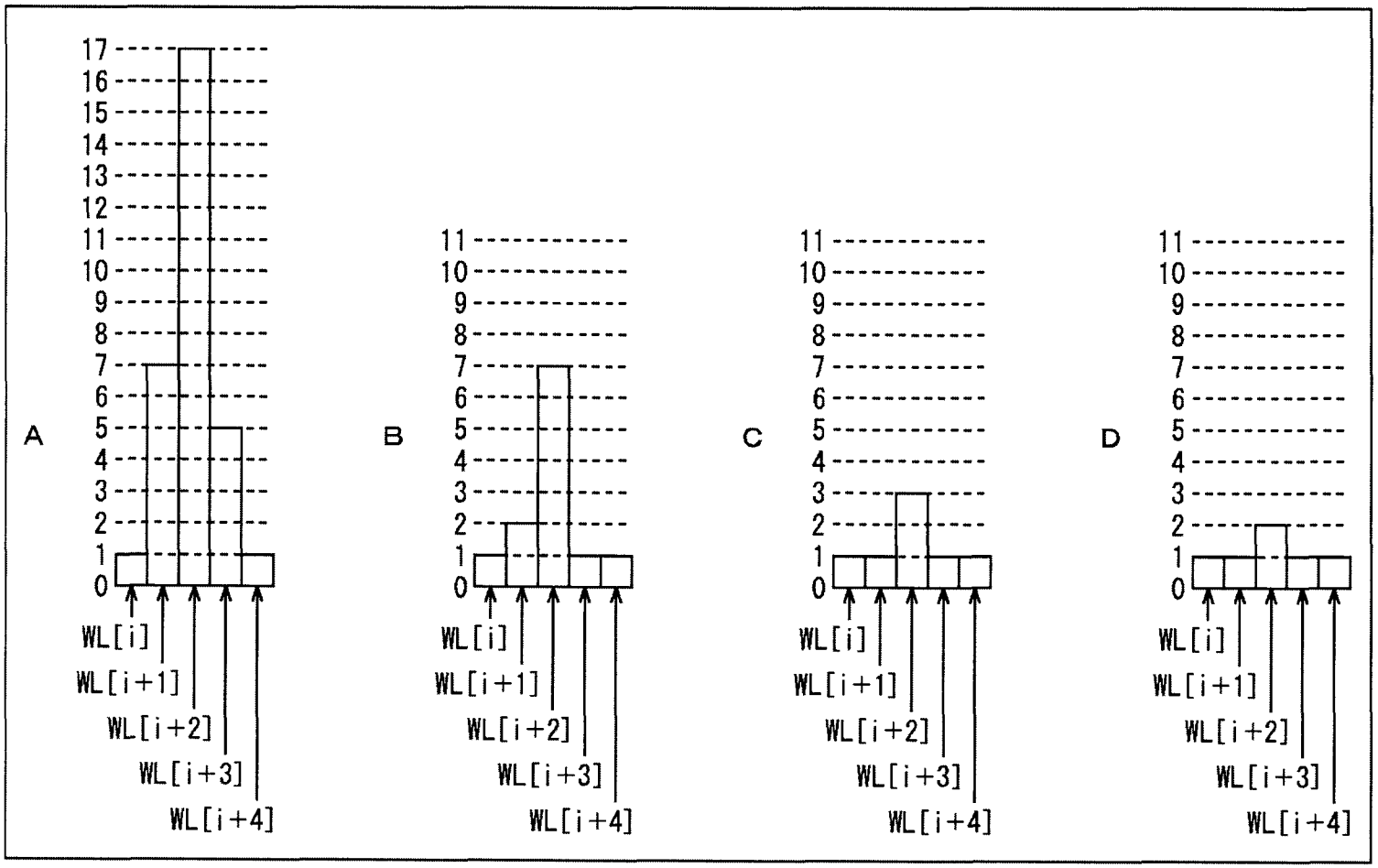
FIG. 25 is a diagram for describing an advantage of preparing a plurality of kinds of arithmetic operations of quantization information.

FIG. 25 is a diagram for describing advantages of preparing a plurality of kinds of arithmetic operations for the quantization information WL.

In the following description referring to FIG. 25, the emphasized envelopes D[i] to D[i+4] shown in FIG. 8C are input into the noise shaping part 151, and the noise shaping G[k] shown in FIG. 10B is generated at the noise shaping part 151.

In this case, as shown in FIG. 25A, the quantization information WL[i] to WL[i+4] generated by the WL arithmetic part 163-1 become 1, 7 (=9−2), 17 (=20−3), 5 (=9−4), and 1 in this order. Therefore, the largest value for the quantization information WL[i] to WL[i+4] is 17, and the average value of the quantization information WL[i] to WL[i+4] is 6.2 (=(1+7+17+5+1)/5. If each of the quantization units is formed by two spectra, the total bit count in the spectra of the quantization units with the indexes i to i+4 becomes 62 (=6.2×2×5).

In addition, as shown in FIG. 25B, the quantization information WL[i] to WL[i+4] generated by the WL arithmetic part 163-2 becomes 1, 2 (≈9/2−2), 7 (=20/2−3), 1, and 1 in this order. Therefore, as shown in FIG. 25B, the quantization information WL[i] to WL[i+4] generated by the WL arithmetic part 163-2 is flattened as compared to the case shown in FIG. 25A. In addition, the largest value of the quantization information WL[i] to WL[i+4] is 7, and the average value of the quantization information WL[i] to WL[i+4] is 2.4 (=(1+2+7+1+1)/5. If each of the quantization units is formed by two spectra, the total bit count in the spectra of the quantization units with the indexes i to i+4 becomes 24 (=2.4×2×5).

Further, as shown in FIG. 25C, the quantization information WL[i] to WL[i+4] generated by the WL arithmetic part 163-3 becomes 1, 1 (=9/3−2), 3 (=20/3−3), 1, and 1 in this order. Therefore, as shown in FIG. 25C, the quantization information WL[i] to WL[i+4] generated by the WL arithmetic part 163-3 is further flattened as compared to the case shown in FIG. 25B. In addition, the largest value of the quantization information WL[i] to WL[i+4] is 3, and the average value of the quantization information WL[i] to WL[i+4] becomes 1.4 (=(1+1+3+1+1)/5. If each of the quantization units is formed by two spectra, the total bit count in the spectra of the quantization units with the indexes i to i+4 becomes 14 (=1.4×2×5).

In addition, as shown in FIG. 25D, the quantization information WL[i] to WL[i+4] generated by the WL arithmetic part 163-4 becomes 1, 1, 2 (=20/4−3), 1, and 1 in this order. Therefore, as shown in FIG. 25D, the quantization information WL[i] to WL[i+4] generated by the WL arithmetic part 163-4 is further flattened as compared to the case shown in FIG. 25C. The largest value of the quantization information WL[i] to WL[i+4] is 2, and the average value of the quantization information WL[i] to WL[i+4] becomes 1.2 (=(1+1+2+1+1)/5. If each of the quantization units is formed by two spectra, the total bit count in the spectra of the quantization units with the indexes i to i+4 becomes 12 (=1.2×2×5).

As in the foregoing, the encoding device 150 allows the bit count N to be modified without having to change the noise shaping G, by preparing the four kinds of arithmetic operations for the quantization information WL. This enhances the degree of freedom for adjustment of the bit count N, as compared to the case where the bit count N is adjusted using only the noise shaping G.

In addition, bit distribution is more intensively made to the quantization units with concentration of the spectra, at the WL arithmetic part 163-1, the WL arithmetic part 163-2, the WL arithmetic part 163-3, and the WL arithmetic part 163-4 in this order. Further, bit distribution is more flattened at the WL arithmetic part 163-4, the WL arithmetic part 163-3, the WL arithmetic part 163-2, and the WL arithmetic part 163-1 in this order. However, the envelopes ENV[k] are emphasized in the encoding device 150, and thus even if the bit distribution is more flattened, a larger number of bits are distributed to the quantization units with concentration of the spectra, as compared to the neighboring quantization units. Accordingly, preparing the four kinds of arithmetic operations for the quantization information WL allows the encoding device 150 to control the degree of intensiveness of bit distribution to the quantization units with concentration of the spectra.

As in the foregoing, the encoding device 150 makes it possible to improve the degree of freedom for adjustment of the bit count N and control the degree of intensiveness of bit distribution to the quantization units with concentration of the spectra, thereby achieving the bit adjustment as in the case of directly controlling the quantization information WL[k]. That is, the encoding device 150 can reduce deterioration in sound quality due to encoding of audio signals as with the encoding device 50, and realize bit adjustment as in the case of directly controlling the quantization information WL[k].

[Description of Advantages of Emphasizing the Envelopes]

Figure 26:
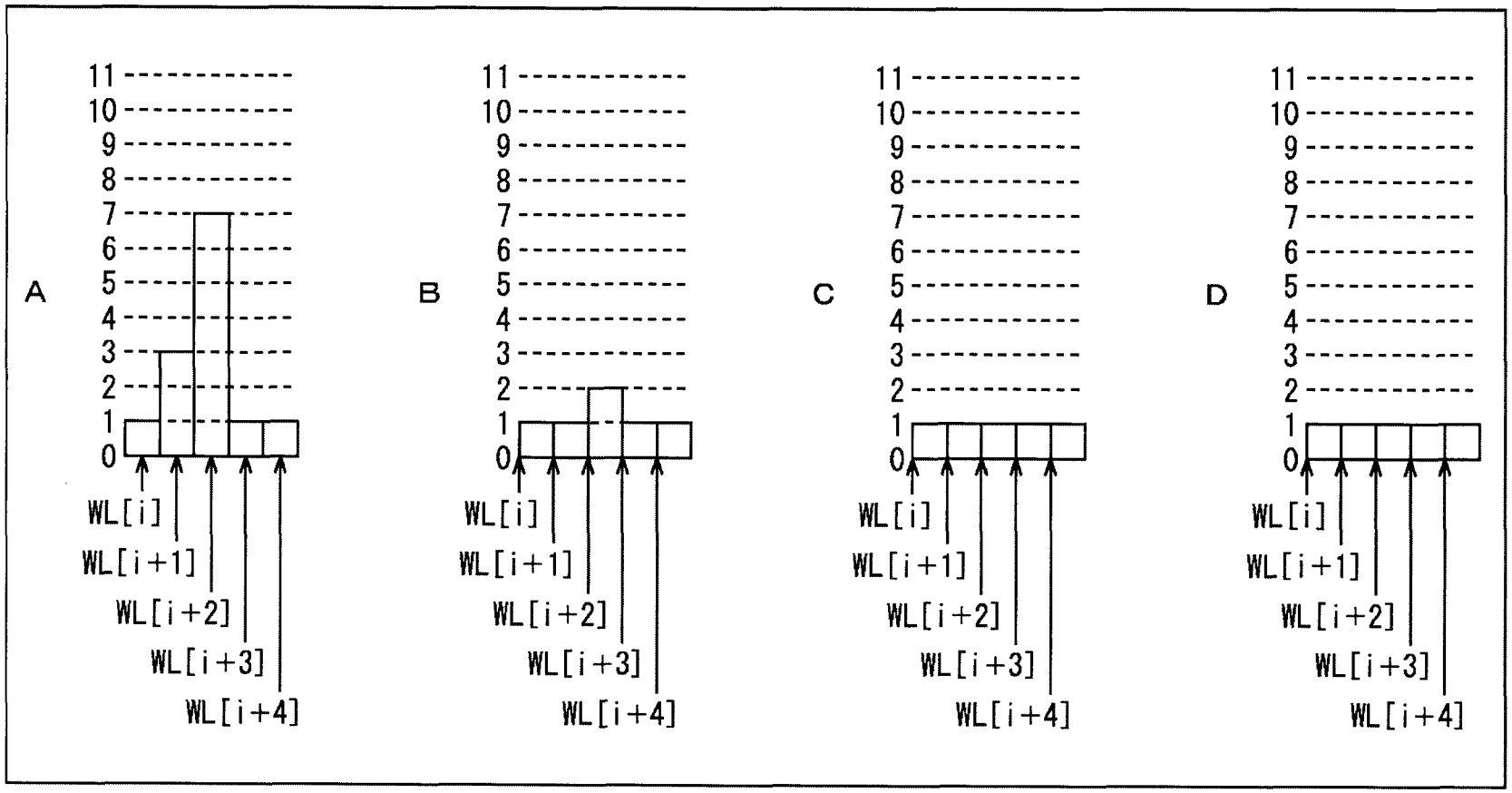
FIG. 26 is a diagram for describing an advantage of emphasizing an envelope.

FIG. 26 is a diagram for describing advantages of emphasizing the envelopes ENV.

In the following description with reference to FIG. 26, the envelopes ENV[i] to ENV[i+4] shown in FIG. 8A are extracted. In this case, as shown in FIG. 26A, the quantization information WL[i] to WL[i+4] generated by the WL arithmetic part 163-1 becomes 1, 3 (=5−2), 7 (=10−3), 1 (=5−4), and 1 in this order. In addition, as shown in FIG. 26B, the quantization information WL[i] to WL[i+4] generated by the WL arithmetic part 163-2 becomes 1, 1, 2 (=10/2−3), 1, and 1 in this order. As shown in FIG. 26C, the quantization information WL[i] to WL[i+4] generated by the WL arithmetic part 163-3 becomes 1, 1, 1, 1, and 1 in this order. As shown in FIG. 26D, the quantization information WL[i] to WL[i+4] generated by the WL arithmetic part 163-4 becomes 1, 1, 1, 1, and 1 in this order.

As in the foregoing, when the envelopes ENV are used without being emphasized, the difference between the quantization information WL of the adjacent quantization units becomes smaller, which leads to flattened bit distribution. Therefore, the degree of freedom for bit adjustment is unlikely to be improved even if the kinds of the arithmetic operations for the quantization information WL are changed.

[Description of a Process Performed by the Encoding Device]

An encoding process performed by the encoding device 150 shown in FIG. 22 is the same as the encoding process shown in FIG. 15, except for the noise shaping at step S15 shown in FIG. 15, and therefore only the noise shaping will be described below.

Figure 27:
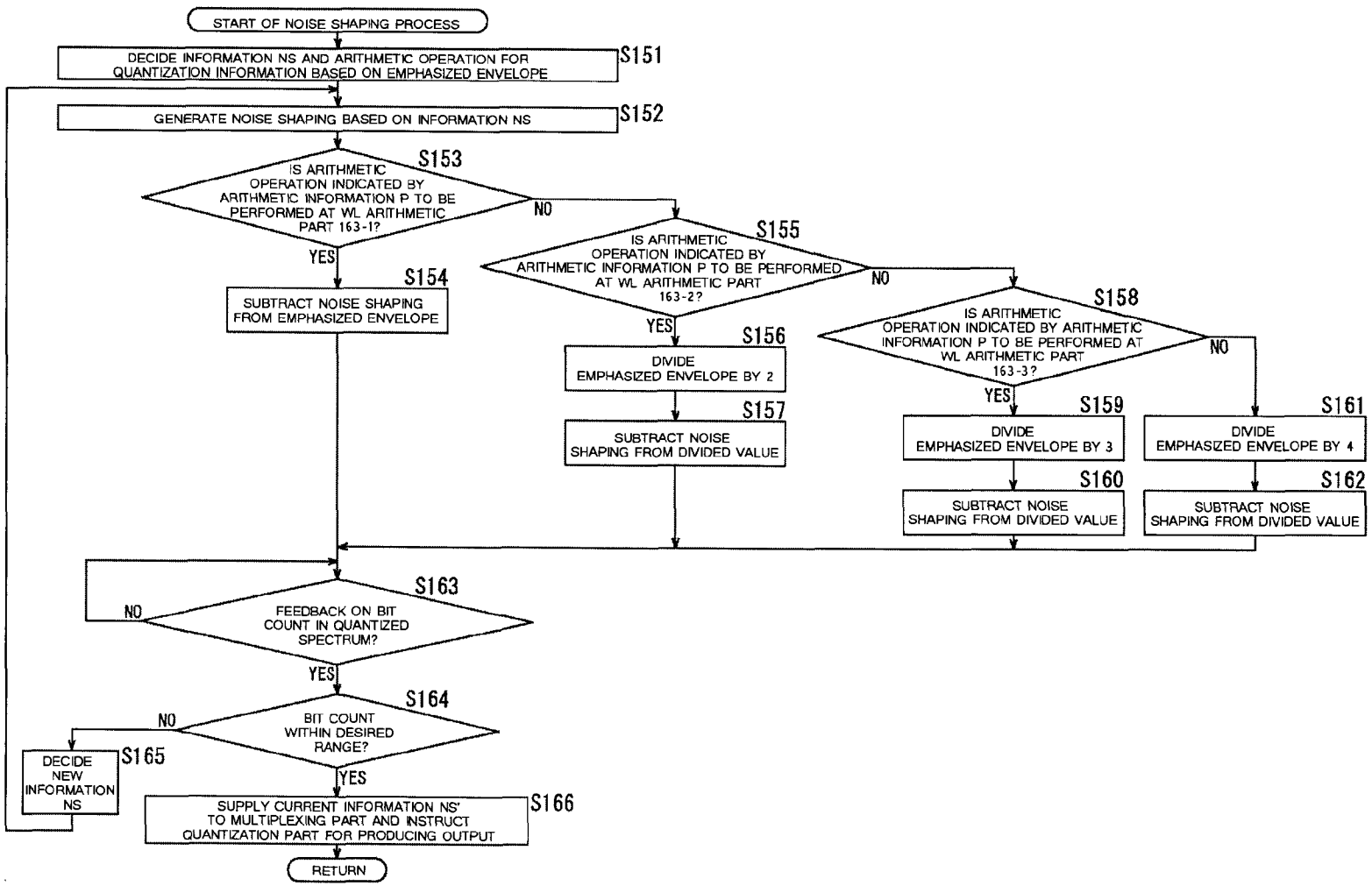
FIG. 27 is a flowchart for describing a noise shaping process performed by the encoding device shown in FIG. 22.

FIG. 27 is a flowchart for describing the noise shaping performed by the encoding device 150 shown in FIG. 22.

At step S151 shown in FIG. 27, the NS' decision part 161 (FIG. 24) of the noise shaping part 151 decides the information NS and the arithmetic operation to be performed, based on the emphasized envelope D[k] supplied from the envelope emphasis part 51 shown in FIG. 22.

Specifically, the NS' decision part 161 selects any of the arithmetic operations for the quantization information WL corresponding to the WL arithmetic parts 163-1 to 163-4, based on the emphasized envelope D[k] and a desired range of the bit count in the bit stream BS". Then, the NS' decision part 161 supplies the arithmetic information P indicative of the selected arithmetic operation to the switch part 162. In addition, the NS' decision part 161 decides as the current information NS an initial value of the information NS preset in association with the arithmetic operation indicated by the arithmetic information P, and supplies the same to the noise shaping generation part 92.

At step S152, the noise shaping generation part 92 generates noise shaping G[k] based on the information NS supplied from the NS' decision part 161. Then, the noise shaping generation part 92 supplies the generated noise shaping G[k] to the switch part 162.

At step S153, the switch part 162 determines whether the arithmetic operation indicated by the arithmetic information P supplied from the NS' decision part 161 is an arithmetic operation to be performed at the WL arithmetic part 163-1.

If determining at step S153 that the arithmetic operation indicated by the arithmetic information P is an arithmetic operation to be performed at the WL arithmetic part 163-1, the switch part 162 supplies the noise shaping G[k] supplied from the noise shaping generation part 92 to the WL arithmetic part 163-1. Then, at step S154, the WL arithmetic part 163-1 subtracts the noise shaping G[k] supplied from the switch part 162, from the emphasized envelope D[k] supplied from the envelope emphasis part 51. In addition, the WL arithmetic part 163-1 supplies a subtracted value as quantization information WL[k] to the quantization part 14 (FIG. 22), and then moves the process to step S163.

In contrast, if determining at step S153 that the arithmetic operation indicated by the arithmetic information P is not an arithmetic operation to be performed at the WL arithmetic part 163-1, the switch part 162 determines at step S155 whether the arithmetic operation indicated by the arithmetic information P supplied from the NS' decision part 161 is an arithmetic operation to be performed at the WL arithmetic part 163-2.

If determining at step S155 that the arithmetic operation indicated by the arithmetic information P is an arithmetic operation to be performed at the WL arithmetic part 163-2, the switch part 162 supplies the noise shaping G[k] supplied from the noise shaping generation part 92 to the WL arithmetic part 163-2. Then, at step S156, the WL arithmetic part 163-2 divides by 2 the emphasized envelope D[k] supplied from the envelope emphasis part 51.

At step S157, the WL arithmetic part 163-2 subtracts the noise shaping G[k] supplied from the switch part 162, from a divided value resulting from step S156. Then, the WL arithmetic part 163-2 supplies a subtracted value as quantization information WL[k] to the quantization part 14, and moves the process to step S163.

In contrast, if determining at step S155 that the arithmetic operation indicated by the arithmetic information P is not an arithmetic operation to be performed at the WL arithmetic part 163-2, the switch part 162 determines at step S158 whether the arithmetic operation indicated by the arithmetic information P supplied from the NS' decision part 161 is an arithmetic operation to be performed at the WL arithmetic part 163-3.

If determining at step S158 that the arithmetic operation indicated by the arithmetic information P is an arithmetic operation to be performed at the WL arithmetic part 163-3, the switch part 162 supplies the noise shaping G[k] supplied from the noise shaping generation part 92 to the WL arithmetic part 163-3. Then, at step S159, the WL arithmetic part 163-3 divides by 3 the emphasized envelope D[k] supplied from the envelope emphasis part 51.

At step S160, the WL arithmetic part 163-3 subtracts the noise shaping G[k] supplied from the switch part 162, from a divided value resulting from step S159. Then, the WL arithmetic part 163-3 supplies a subtracted value as quantization information WL[k] to the quantization part 14, and moves the process to step S163.

In contrast, if determining at step S158 that the arithmetic operation indicated by the arithmetic information P is not an arithmetic operation to be performed at the WL arithmetic part 163-3, that is, that the arithmetic operation indicated by the arithmetic information P is an arithmetic operation to be performed at the WL arithmetic part 163-4, the switch part 162 supplies the noise shaping G[k] supplied from the noise shaping generation part 92 to the WL arithmetic part 163-4. Then, at step S161, the WL arithmetic part 163-4 divides by 4 the emphasized envelope D[k] supplied from the envelope emphasis part 51.

At step S162, the WL arithmetic part 163-4 subtracts the noise shaping G[k] supplied from the switch part 162, from a divided value resulting from step S161. Then, the WL arithmetic part 163-4 supplies a subtracted value as quantization information WL[k] to the quantization part 14, and moves the process to step S163.

At step S163, the NS' decision part 161 determines whether there is feedback from the quantization part 14 on the bit count N in the quantized spectrum QS[k] quantized on the basis of the quantization information WL supplied to the quantization part 14 at step S154, S157, S160, or S162.

If it is determined at step S163 that the bit count N is not fed back from the quantization part 14, feedback of the bit count N is waited for.

In contrast, if determining at step S163 that the bit count N is fed back from the quantization part 14, the NS' decision part 161 then determines at step S164 whether the bit count in the bit stream BS" falls within a desired range, according to the bit count N.

If determining at step S164 that the bit count in the bit stream BS" does not fall within a desired range, the NS' decision part 161 decides new information NS such that the bit count in the bit stream BS" falls within a desired range at step S165. Then, the NS' decision part 161 supplies the decided information NS to the noise shaping generation part 92, and returns the process to step S152. The NS' decision part 161 repeats steps S152 to S165 until the bit count in the bit stream BS" falls within a desired range.

In contrast, if determining at step S164 that the bit count in the bit stream BS" falls within a desired range, the NS' decision part 161 supplies the current information NS and the arithmetic information P as information NS' to the multiplexing part 152 (FIG. 22) and instructs the quantization part 14 for producing an output at step S166. The process returns to step S15 shown in FIG. 15, and then moves to step S16.

[Configuration Example of a Decoding Device]

Figure 28:
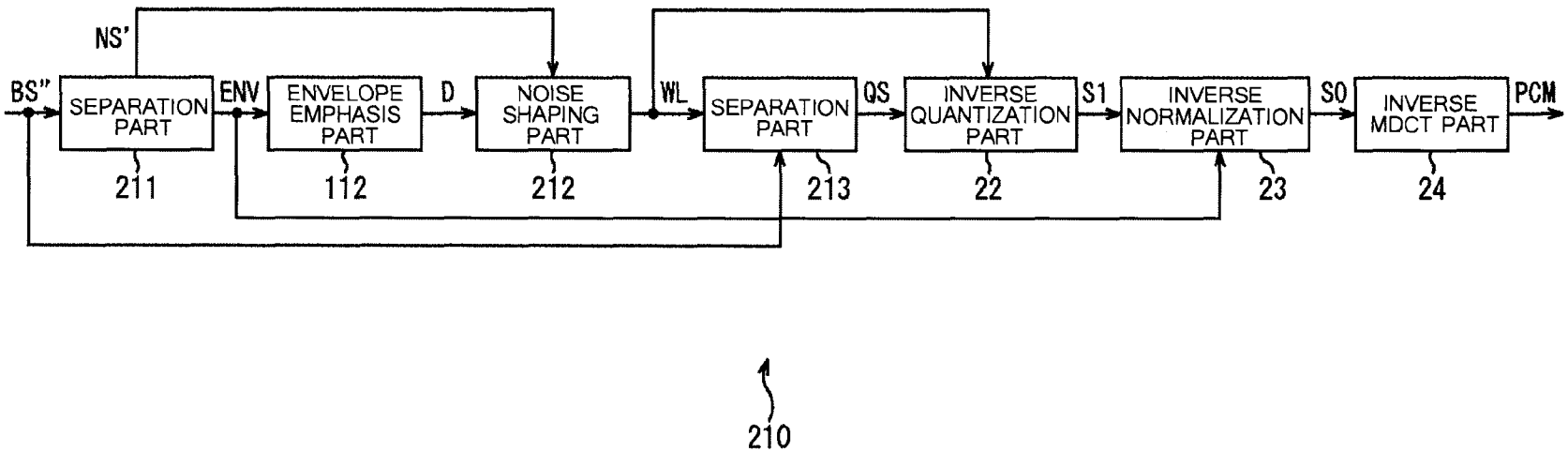
FIG. 28 is a bock diagram showing a configuration example of a decoding device that decodes a bit stream encoded by the encoding device shown in FIG. 22.

FIG. 28 is a block diagram showing a configuration example of a decoding device decoding the bit stream BS" encoded by the encoding device 150 shown in FIG. 22.

The same components in the configuration shown in FIG. 28 as those in the configuration shown in FIG. 18 are given the same reference numerals as those in the configuration shown in FIG. 18. Duplicated descriptions on the same components will be omitted here as appropriate.

The configuration of a decoding device 210 shown in FIG. 28 is different from the configuration shown in FIG. 18, mainly in that a separation part 211, a noise shaping part 212, and a separation part 213 are provided in place of the separation part 111, the noise shaping part 113, and the separation part 114.

The bit stream BS" encoded by the encoding device 150 is input into the separation part 211 of the decoding device 210. The separation part 211 separates the envelope ENV[k] by quantization unit and the information NS' from the bit stream BS". The separation part 211 supplies the envelope ENV to the envelope emphasis part 112 and the inverse normalization part 23, and supplies the information NS' to the noise shaping part 212.

The noise shaping part 212 generates the quantization information WL[k] by performing an arithmetic operation indicated by the arithmetic information P in the information NS', using the emphasized envelope D[k] by quantization unit generated by the envelope emphasis part 112 and noise shaping G[k] by quantization unit specified by NS in the information NS' from the separation part 211. The noise shaping part 212 supplies the quantization information WL[k] to the separation part 213 and the inverse quantization part 22. Details of the noise shaping part 212 will be provided with reference to FIG. 29 described later.

The separation part 213 separates the quantized spectrum QS[k] from the bit stream BS" input from the encoding device 150, based on the quantization information WL[k] supplied from the noise shaping part 212. The separation part 213 supplies the quantized spectrum QS[k] to the inverse quantization part 22.

[Detailed Configuration Example of the Noise Shaping Part]

Figure 29:
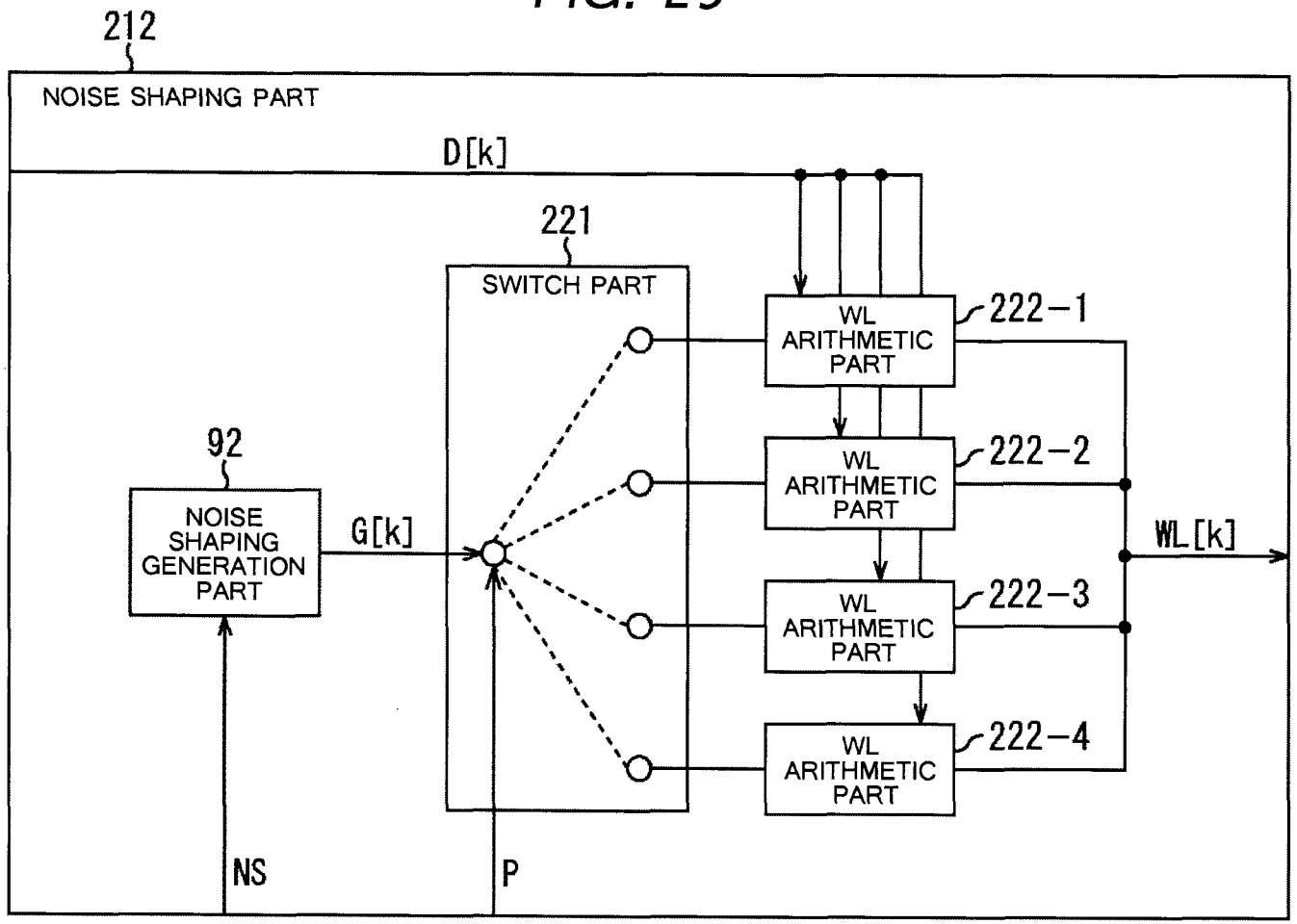
FIG. 29 is a block diagram showing a detailed configuration example of the noise shaping part shown in FIG. 28.

FIG. 29 is a block diagram showing a detailed configuration example of the noise shaping part 212 shown in FIG. 28.

The same components in the configuration shown in FIG. 29 as those in the configuration shown in FIG. 19 are given the same reference numerals as those in the configuration shown in FIG. 19. Duplicated descriptions on the same components will be omitted here as appropriate.

The configuration of the noise shaping part 212 shown in FIG. 29 is different from the configuration shown in FIG. 19, mainly in that a switch part 221 is newly provided, and WL arithmetic parts 222-1 to 222-4 are provided in place of the division part 122 and the subtraction part 123.

The switch part 221 (selection means) is configured in the same manner as the switch part 162 shown in FIG. 24. Input into the switch part 221 is noise shaping G[k] generated by the noise shaping generation part 121 based on the information NS in the information NS' supplied from the separation part 211. In addition, input into the switch part 221 is arithmetic information P in the information NS' supplied from the separation part 211. The switch part 221 selects, based on the input arithmetic information P, the WL arithmetic part to determine the quantization information WL by an arithmetic operation indicated by the arithmetic information P, from among the WL arithmetic parts 222-1 to 222-4. The switch part 221 supplies the noise shaping G[k] to the selected one of the WL arithmetic parts 222-1 to 222-4, to perform the arithmetic operation.

The WL arithmetic parts 222-1 to 222-4 are configured in the same manner as the WL arithmetic parts 163-1 to 163-4 shown in FIG. 24, and thus detailed descriptions thereof will be omitted here.

[Description of a Process Performed by the Decoding Device]

The decoding process performed by the decoding device 210 shown in FIG. 28 is the same as the decoding process shown in FIG. 20, except for the noise shaping at step S103 shown in FIG. 20, and thus only the noise shaping will be described below.

Figure 30:
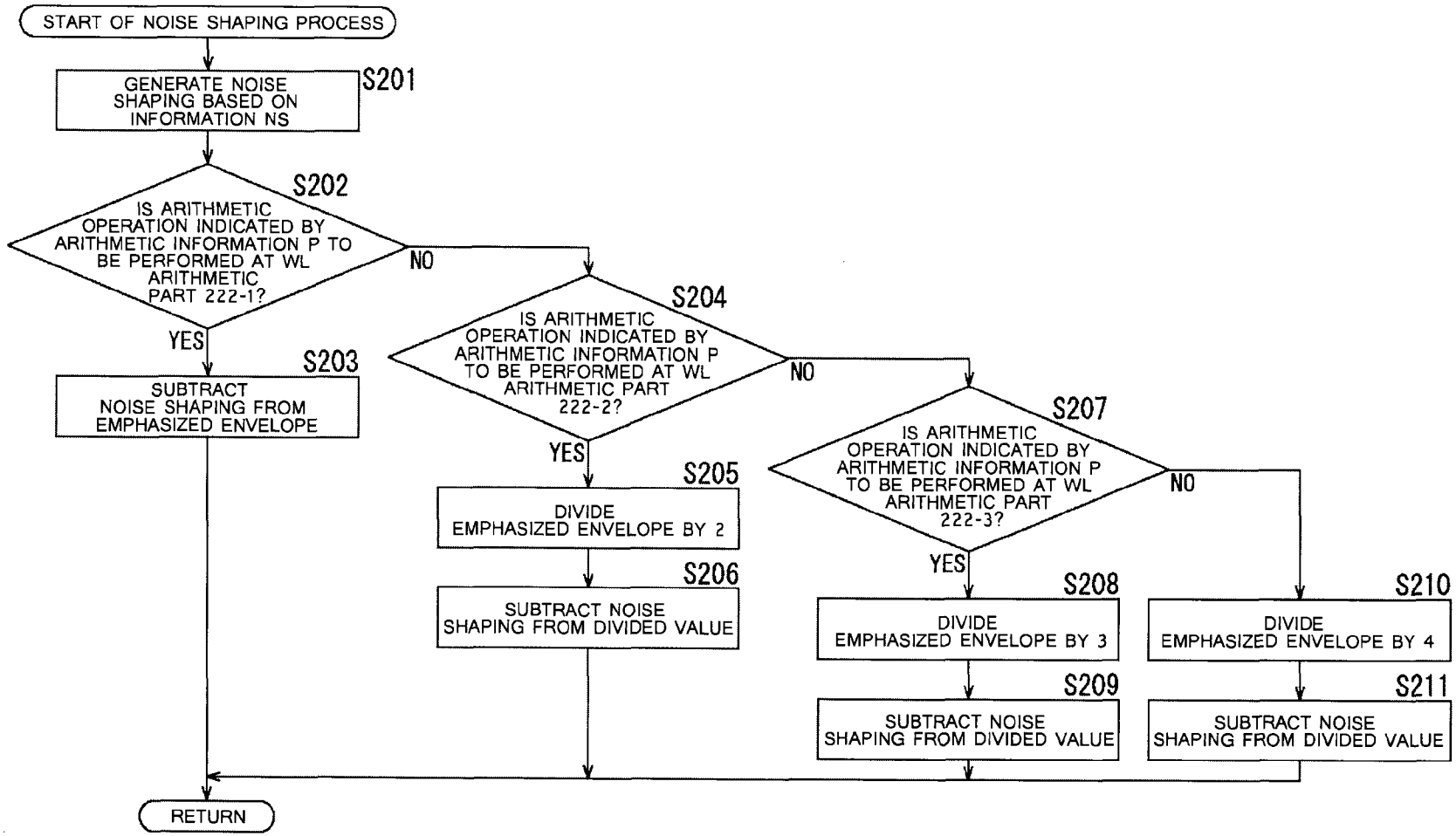
FIG. 30 is a flowchart for describing a noise shaping process performed by the decoding device shown in FIG. 28.

FIG. 30 is a flowchart for describing the noise shaping performed by the decoding device 210 shown in FIG. 28.

At step S201 shown in FIG. 30, the noise shaping generation part 121 (FIG. 29) of the noise shaping part 212 generates noise shaping G[k] based on the information NS in the information NS' supplied from the separation part 211 shown in FIG. 28. Then, the noise shaping generation part 121 supplies the generated noise shaping G[k] to the switch part 221.

Steps S202 to S211 are equivalent to steps S153 to S162 shown in FIG. 27 performed by the WL arithmetic parts 222-1 to 222-4 in placed of the WL arithmetic parts 163-1 to 163-4 shown in FIG. 24, and thus a description thereof will be omitted here. In addition, the arithmetic information P to be determined at steps S202, S204, and S207 is arithmetic information P in the information NS' supplied from the separation part 211.

In the foregoing description, the noise shaping G of the first quantization unit has the lowest value L, and the noise shaping G of the last quantization unit has the highest value H. Alternatively, arbitrary quantization units may be set as quantization units corresponding to the lowest value L and the highest value H. In this case, the information NS (NS') includes position information X indicative of an index of a quantization unit corresponding to the lowest value L, and position information Y indicative of an index of a quantization unit corresponding to the highest value H. This makes it possible to further improve the degree of freedom for bit distribution.

In addition, the kinds of arithmetic operations for the quantization information WL are not limited to the foregoing four. Alternatively, a plurality of kinds of arithmetic operations for noise shaping G, not a plurality of kinds of arithmetic operations for quantization information WL, may be prepared, and information indicative of a used arithmetic operation may be included in the information NS (NS'). In addition, a plurality of methods for generating an emphasized envelope D may be prepared, and information indicative of a used generation method may be included in the information NS (NS'). In this case, the method for generating an emphasized envelope D is selected by the kinds of arithmetic operations for quantization information WL, for example.

Alternatively, pluralities of kinds of arithmetic operations for quantization information WL, arithmetic operations for noise shaping G, and methods for generating an emphasized envelope D, may be prepared, and information indicative of used arithmetic operations and a used generation method may be included in the information NS (NS').

If the bit count needed for transfer of the information NS (NS') is sufficiently smaller than the bit count NWL needed for transfer of the quantization information WL, the information included in the information NS (NS') is not limited to the foregoing information.

Third embodiment

[Description of a Computer to Which the Invention is Applied]

The foregoing series of processes performed by the encoding device 50 (150) and the decoding device 110 (210) may be carried out through hardware or software. If the series of processes performed by the encoding device 50 (150) and the decoding device 110 (210) are carried out through software, a program constituting the software is installed into a general-purpose computer or the like.

Figure 31:
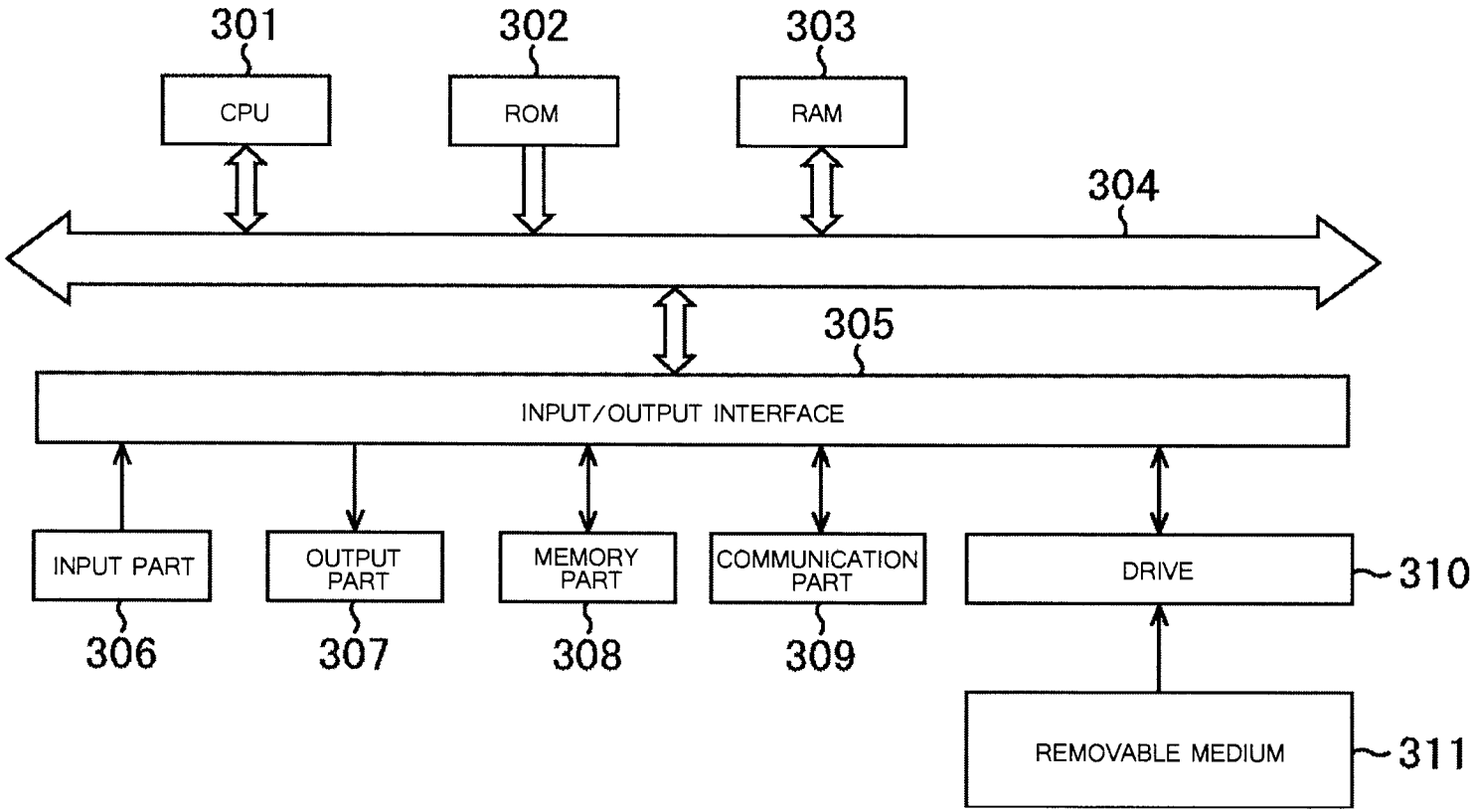
FIG. 31 is a diagram showing a configuration example of one embodiment of a computer.

FIG. 31 is a diagram showing a configuration example of one embodiment of a computer to which the program for performing the foregoing series of processes is installed.

The program may be stored in advance in a memory part 308 or a ROM (Read Only Memory) 302 as a recording medium built in the computer.

Alternatively, the program may be stored (recorded) in a removable medium 311. The removable medium 311 can be provided as so-called package software. The removable medium 311 here may be a flexible disc, a CD-ROM (Compact Disc Read Only Memory), an MO (Magneto Optical) disc, a DVD (Digital Versatile Disc), a magnetic disc, a semiconductor memory, or the like.

The program may be installed into the computer from the removable medium 311 via a drive 310, or be downloaded into the computer via a communications network or a broadcast network and then installed in the built-in memory part 308. Specifically, the program can be transferred wirelessly to the computer via an artificial satellite for digital satellite broadcasting, or may be transferred in a wired manner to the computer via a network such as a LAN (Local Area Network) or the Internet, for example.

The computer contains a CPU (Central Processing Unit) 301 to which an input/output interface 305 is connected via a bus 304.

When a command is issued by a user operating an input part 306 or the like via the input/output interface 305, the CPU 301 performs the program stored in the ROM 302 accordingly. Otherwise, the CPU 301 loads the program stored in the memory part 308 into a RAM (Random Access Memory) 303 for execution.

Accordingly, the CPU 301 performs the foregoing processes according to the flowcharts or the foregoing processes according to the configurations shown in the block diagrams. Then, the CPU 301 causes as necessary an output part 307 to output results of the processes, a communication part 309 to transmit the same, the memory part 308 to record the same, or the like, via the input/output interface 305.

The input part 306 is formed by a keyboard, a mouse, a microphone, and the like. The output part 307 is formed by an LCD (Liquid Crystal Display), a speaker, and the like.

The processes performed by the computer according to the program herein may not necessarily be carried out in chronological order described in the flowcharts. That is, the processes performed by the computer according to the program include processes performed in parallel or individually (for example, parallel processes or object processes).

In addition, the program may be processed by one computer (processor) or subjected to distributed processing by a plurality of computers. Further, the program may be transferred to a distant computer for execution.

The embodiment of the invention is not limited to the foregoing ones, but may be modified in various manners without deviating from the gist of the invention.

REFERENCE SIGNS LIST

12 Normalization part
14 Quantization part
22 Inverse quantization part
23 Inverse normalization part
50 Encoding device
51 Envelope emphasis part
52 Noise shaping part
53 Multiplexing part
91 NS decision part
110 Decoding device
111 Separation part
112 Envelope emphasis part
113 Noise shaping part
114 Separation part
150 Encoding device
151 Noise shaping part
152 Multiplexing part
161 NS' decision part
162 Switch part
163-1 to 163-4 WL arithmetic part
210 Decoding device
211 Separation part
212 Noise shaping part
213 Separation part
221 Switch part
222-1 to 222-4 WL arithmetic part

The invention claimed is:

1. An encoding device, comprising:

a normalization means that extracts an envelope from a spectrum of an audio signal and normalizes the spectrum using the envelope;

an envelope emphasis means emphasizing the envelope;

a noise shaping means that divides the envelope emphasized by the envelope emphasis means by a value larger than 1 and subtracts noise shaping specified by predetermined information from a result of the division;

a quantization means that sets a result of the subtraction by the noise shaping means as a quantization bit count and quantizes the spectrum normalized by the normalization means, based on the a quantization bit count; and a multiplexing means that multiplexes the predetermined information, the spectrum quantized by the quantization means, and the envelope.

2. The encoding device according to claim 1, wherein the predetermined information is information indicative of a lowest value and a highest value of the noise shaping.

3. The encoding device according to claim 1, further comprising an information decision means that decides the predetermined information according to the envelope emphasized by the envelope emphasis means.

4. The encoding device according to claim 3, wherein the information decision means updates the predetermined information, according to a bit count of the spectrum quantized by the quantization means based on the previous quantization bit count.

5. The encoding device according to claim 1, wherein the noise shaping means includes:

a first arithmetic means that divides the envelope emphasized by the envelope emphasis means by a first value larger than 1, and performs a first arithmetic operation to subtract the noise shaping from a result of the division;

a second arithmetic means that divides the envelope emphasized by the envelope emphasis means by a second value different from the first value larger than 1, and performs a second arithmetic operation to subtract the noise shaping from a result of the division; and a selection means that selects the first arithmetic means or the second arithmetic means, and causes the selected first arithmetic means or second arithmetic means to perform an arithmetic operation, wherein the multiplexing means multiplexes the predetermined information, the spectrum, the envelope, and arithmetic information indicative of the first arithmetic operation or the second arithmetic operation corresponding to the first arithmetic means or the second arithmetic means selected by the selection means.

6. The encoding device according to claim 5, further comprising an information decision means that decides the predetermined information and the arithmetic information, based on the envelope emphasized by the envelope emphasis means, wherein the selection means selects the first arithmetic operation or the second arithmetic operation based on the arithmetic information.

7. The encoding device according to claim 6, wherein the information decision means updates at least the predetermined information according to a bit count in the spectrum quantized by the quantization means based on the previous quantization bit count.

8. An encoding method for an encoding device, comprising:

a normalization step of extracting an envelope from a spectrum of an audio signal and normalizing the spectrum using the envelope;

an envelope emphasis step of emphasizing the envelope;

a noise shaping step of dividing the envelope emphasized at the envelope emphasis step by a value larger than 1 and subtracting noise shaping specified by predetermined information from a result of the division;

a quantization step of setting a result of the subtraction at the noise shaping step as a quantization bit count and quantizing the spectrum normalized at the normalization step, based on the a quantization bit count; and a multiplexing step of multiplexing the predetermined information, the spectrum quantized at the quantization step, and the envelope.

9. A program for causing a computer to perform a process comprising:

a normalization step of extracting an envelope from a spectrum of an audio signal and normalizing the spectrum using the envelope;

an envelope emphasis step of emphasizing the envelope;

a noise shaping step of dividing the envelope emphasized at the envelope emphasis step by a value larger than 1 and subtracting noise shaping specified by predetermined information from a result of the division;

a quantization step of setting a result of the subtraction at the noise shaping step as a quantization bit count and quantizing the spectrum normalized at the normalization step, based on the a quantization bit count; and a multiplexing step of multiplexing the predetermined information, the spectrum quantized at the quantization step, and the envelope.

10. A decoding device comprising:

an information separation means that separates, from multiplexed predetermined information, a quantized spectrum of an audio signal and an envelope of the spectrum, the predetermined information and the envelope;

an envelope emphasis means emphasizing the envelope;

a noise shaping means that divides the envelope emphasized by the envelope emphasis means by a value larger than 1, and subtracts noise shaping specified by the predetermined information from a result of the division;

a spectrum separation means that separates the quantized spectrum from the multiplexed predetermined information, the quantized spectrum, and the envelope, using a result of the subtraction by the noise shaping means as a quantization bit count;

an inverse quantization means that inversely quantizes the quantized spectrum based on the quantization bit count; and an inverse normalization means that inversely normalizes the spectrum inversely quantized by the inverse quantization means, using the envelope.

11. The decoding device according to claim 10, wherein the predetermined information is information indicative of a lowest value and a highest value of the noise shaping.

12. The decoding device according to claim 10, wherein the information separation means separates the predetermined information, the envelope, and the arithmetic information from arithmetic information indicative of the multiplexed predetermined information, the spectrum, the envelope, and arithmetic information indicative of an arithmetic operation performed by the noise shaping means, and the noise shaping means includes:

a first arithmetic means that divides the envelope emphasized by the envelope emphasis means by a first value larger than 1, and performs a first arithmetic operation to subtract the noise shaping from a result of the division;

a second arithmetic means that divides the envelope emphasized by the envelope emphasis means by a second value different from the first value larger than 1, and performs a second arithmetic operation to subtract the noise shaping from a result of the division; and a selection means that selects the first arithmetic means or the second arithmetic means based on the arithmetic information, and causes the selected first arithmetic means or second arithmetic means to perform an arithmetic operation.

13. A decoding method for a decoding device comprising:

an information separation step of separating, from the multiplexed predetermined information, a quantized spectrum of an audio signal and an envelope of the spectrum, the predetermined information and the envelope;

an envelope emphasis step of emphasizing the envelope;

a noise shaping step of dividing the envelope emphasized at the envelope emphasis step by a value larger than 1 and subtracting noise shaping specified by the predetermined information from a result of the division;

a spectrum separation step of separating the quantized spectrum from the multiplexed predetermined information, the quantized spectrum, and the envelope, using a result of the subtraction at the noise shaping step as a quantization bit count;

an inverse quantization step of inversely quantizing the quantized spectrum based on the quantization bit count; and an inverse normalization step of inversely normalizing the spectrum inversely quantized at the inverse quantization step, using the envelope.

14. A program for causing a computer to perform a process comprising:

an information separation step of separating, from the multiplexed predetermined information, a quantized spectrum of an audio signal and an envelope of the spectrum, the predetermined information and the envelope;

an envelope emphasis step of emphasizing the envelope;

a noise shaping step of dividing the envelope emphasized at the envelope emphasis step by a value larger than 1 and subtracting noise shaping specified by the predetermined information from a result of the division;

a spectrum separation step of separating the quantized spectrum from the multiplexed predetermined information, the quantized spectrum, and the envelope, using a result of the subtraction at the noise shaping step as a quantization bit count;

an inverse quantization step of inversely quantizing the quantized spectrum based on the quantization bit count; and an inverse normalization step of inversely normalizing the spectrum inversely quantized at the inverse quantization step, using the envelope.

* * * * *